US006095671A

United States Patent [19]

Hutain

[11] Patent Number: 6,095,671

[45] Date of Patent: Aug. 1, 2000

[54] ACTIVELY COOLED LIGHTING TRIM APPARATUS

[76] Inventor: Barry Hutain, 14744 Washington Ave., #308, San Leandro, Calif. 94578

[21] Appl. No.: 09/227,496

[22] Filed: Jan. 7, 1999

[51] Int. Cl.[7] ..... F21V 29/00

[52] U.S. Cl. ..... 362/373; 362/264; 362/276; 362/294; 362/365

[58] Field of Search ..... 362/96, 264, 294, 362/373, 365, 276

[56] References Cited

U.S. PATENT DOCUMENTS

| | | | |
|---|---|---|---|
| 4,450,512 | 5/1984 | Kristofek | 362/276 |
| 4,546,420 | 10/1985 | Wheeler et al. | 362/268 |
| 4,586,117 | 4/1986 | Collins | 362/373 |
| 4,680,448 | 7/1987 | Fester | 219/365 |
| 4,701,833 | 10/1987 | Bornhorst | 362/299 |
| 4,843,524 | 6/1989 | Krent et al. | 362/127 |
| 4,882,467 | 11/1989 | Dimick | 219/219 |
| 4,930,054 | 5/1990 | Krebs | 362/149 |
| 5,021,932 | 6/1991 | Ivey | 362/96 |
| 5,416,541 | 5/1995 | Fog | 353/119 |
| 5,458,505 | 10/1995 | Prager | 439/485 |
| 5,565,903 | 10/1996 | Ueda | 347/175 |
| 5,626,416 | 5/1997 | Romano et al. | 362/264 |
| 5,664,872 | 9/1997 | Spearman et al. | 362/96 |
| 5,743,631 | 4/1998 | Bigham | 362/294 |
| 5,748,837 | 5/1998 | Lokar et al. | 392/411 |

OTHER PUBLICATIONS

Prescolite, Inc., data sheet for LiteBox PBX incandescent and horizontal compact fluorescent type non–IC housing, undated (admitted prior art).

Prescolite, Inc., data sheet for LiteBox IBXTP incandescent and horizontal compact fluorescent type I.C. housing, undated (admitted prior art).

Prescolite, Inc., data sheet for LiteBox IBX6 incandescent type I.C. shallow housing, undated (admitted prior art).

Prescolite, Inc., data sheet for LiteBox IBX incandescent type I.C. fixture, undated (admitted prior art).

AMP Inc., data sheet for Universal Mate–N–Lok Connectors, undated (Admitted prior art).

Leviton, data sheets for U–2, U–3, U–4, U–9 snap–in convenience outlets, undated (admitted prior art).

Leviton data sheets for O–4, O–5 self–heating thermal protectors, undated (admitted prior art).

Leviton, data sheet for N–3 mogul base pulse rated lanpholders, undated (admitted prior art).

Leviton data sheet for K–39 medium and mogul base adapters and extensions, undated (admitted prior art).

Orion Fans, data sheets for OD 8025 DC fan and OA 825 AC fan, undated (admitted prior art).

Texas Instruments, data sheet for 7am Thermal Protectors, 1998.

*Primary Examiner*—Stephan Husar

*Attorney, Agent, or Firm*—Hickman Palermo Truong & Becker LLP; Christopher J. Palermo; Carl L. Brandt

[57] ABSTRACT

An actively cooled recessed lighting trim apparatus is disclosed. The trim apparatus comprises a trim housing that fits within a standard recessed lighting fixture housing to define a space between the lighting fixture housing and the trim housing; a trim ring or face that has a vent for admitting a cooling fluid to the space; and a means for actively cooling the space or the trim housing. The space forms a low-pressure plenum through which a cooling fluid is circulated. A thermal protector may be secured within the trim housing to turn off a lamp in the housing if the internal temperature of the space, or of the trim housing, becomes too hot. The cooling means, which may be a fan, actively draws a cooling fluid in through the vent of the trim ring, over the trim housing and the illuminated lamp, and exhausts warmed cooling fluid out though gaps between the lamp and the trim ring. Accordingly, high-wattage lamps may be used safely in recessed lighting installations.

37 Claims, 22 Drawing Sheets

Fig. 2D
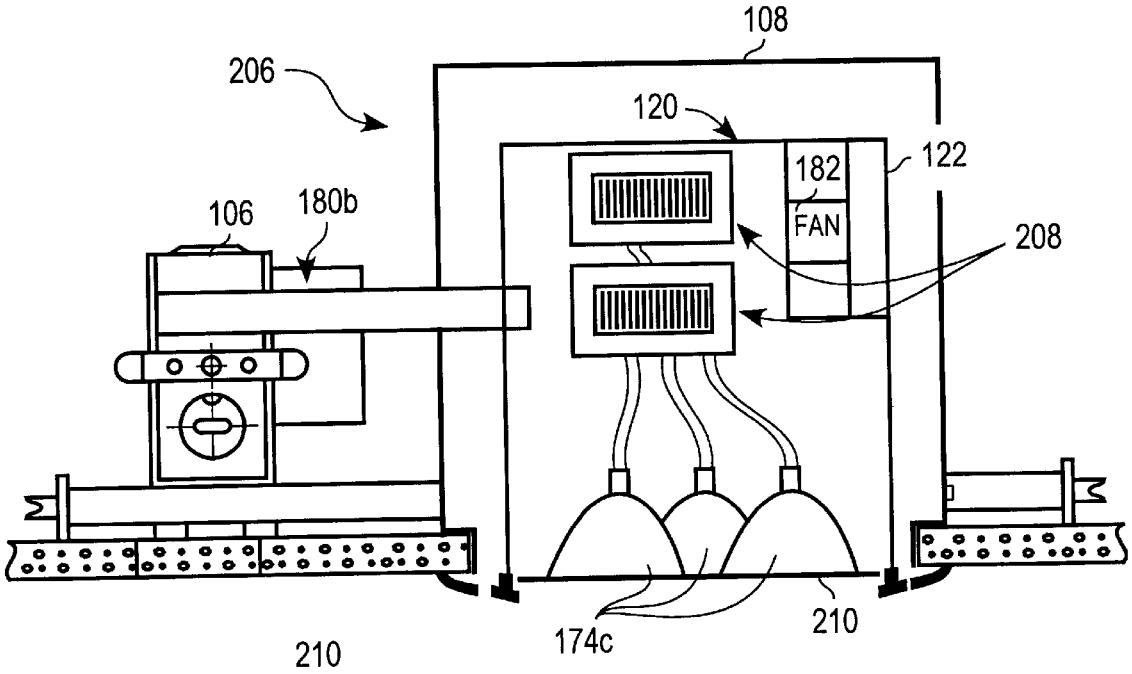
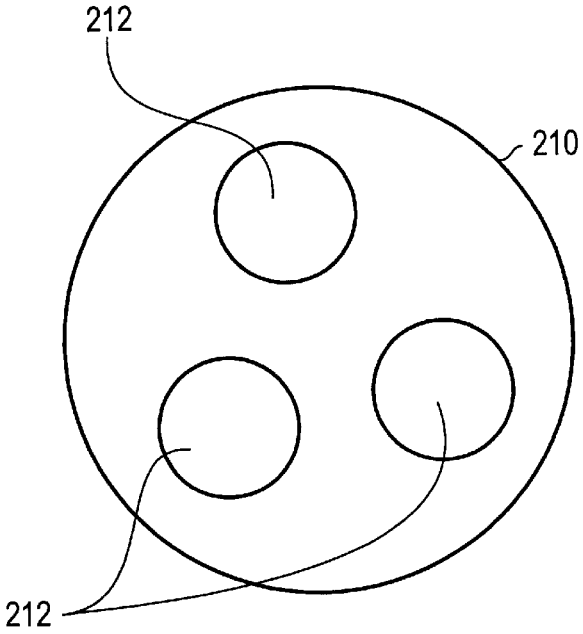
Fig. 2E

ACTIVELY COOLED LIGHTING TRIM APPARATUS

FIELD OF THE INVENTION

The present invention generally relates to the field of electric lighting. The invention relates more specifically to trims used in recessed lighting apparatus.

BACKGROUND OF THE INVENTION

High-wattage lamps are commonly used in commercial and residential lighting. Recessed lighting fixtures are popular in these applications. However, a continuing problem in recessed lighting is that certain high-wattage lamps cannot be used, because they generate so much heat in operation that they present a fire hazard.

A recessed lighting fixture has a housing that is installed in a recess between ceiling joists or other ceiling members. FIG. 1A is a perspective view of a lighting fixture housing 100, which comprises arms 102, 104 that are secured to the ceiling members, a junction box 106 for receiving conduit and wiring, and a downward facing, open housing or box 108 that encloses and protects other elements of the fixture. The open box accepts any of several kinds of trims (not shown) through hole 110. The trim is secured within the box using screws or locking metal tabs or springs that engage complementary slots. A trim comprises a lamp socket, wiring that is coupled to the wiring of the box 108, and cosmetic elements such as a rim or gimbaled eyeball mechanism. The lamp socket receives a lamp.

There are dozens of different trim types and styles, each of which is compatible with the housing 100 or other standard housings. The housing 100 may be, for example, one of the housings offered under the brand name LiteBox by Prescolite, Inc. of San Leandro, Calif.

The type of lamp that can be used in a recessed fixture, however, is limited by fire codes and other safety concerns. Lamps that draw high current or operate at high wattage may become so hot in operation that they ignite the ceiling members or surrounding ceiling insulation. The lamps are cooled only by passive dissipation of heat from the metal housing or trim to the ceiling airspace and ceiling members. Thus, currently, the maximum allowable wattage ratings of such fixtures are restricted by the ability of the housing to carry out passive heat transfer to the ambient environment. This problem becomes acute when the ceiling is packed with flammable insulation.

For this reason, most recessed lighting housings are rated either for insulation contact ("IC-rated"), or may not be used in direct contact with insulation ("non IC-rated").

The allowable housing surface temperature differs for IC and non-IC-rated fixtures, according to the National Electrical Code (NEC). IC-rated fixture housing temperatures may reach only 90° C. at any point that touches potentially flammable material. The housings of non-IC fixtures may reach 150° C., but points of support and junction boxes may not exceed 90° C.

However, there is a continuing need and desire to use high-wattage lamps in recessed fixtures. For example, high-wattage lamps are useful when large areas are lit, when ceilings are high, and in specialty settings such as retail store lighting. Accordingly, there is a need for a way to cool a lamp, a housing, a trim, or a fixture to enable higher wattage lamps to be used in recessed lighting. Prior fixtures that do not have a thermal protector generally can not comply with NEC requirements when a high-wattage lamp is used.

The construction industry tends to favor standards in the construction of electrical products. Contractors and electricians find it convenient to repeatedly use housings, trims, and other products that have a familiar shape, size, and mechanical constructions. Thus, there is a need for an apparatus that enables a high-wattage lamp to be used in an existing recessed lighting housing without modification by the end user.

Electricians, contractors, and other end users also appreciate the ability to change the configuration of a light fixture. For example, long after a light fixture is installed in a permanent recessed ceiling location, the purpose of the room that is illuminated by the fixture may change. Remodeling may occur. The end user of the fixture may wish to change the type or brightness of the lamp used in the fixture. Thus, there is a need for an apparatus that enables a high-wattage lamp to be used in a recessed lighting fixture, and also enables the type or brightness of the lamp to be easily changed.

Certain work of others shows a fan in combination with a lamp, as exemplified by U.S. Pat. No. 5,664,872 (Spearman et al.); U.S. Pat. No. 5,458,505 (Prager); U.S. Pat. No. 5,021,932 (Ivey); and U.S. Pat. No. 5,626,416 (Romano et al.). However, this other work does not overcome the above-noted problems.

Spearman describes a combined fan-lamp assembly in which the fan is intended to ventilate room air and not to cool the lamp. The lamp of Spearman is enclosed in a sealed compartment that does not receive airflow from the fan. The fan exhaust is directed upward into a duct or the ceiling area and not back into the room where it can be cooled. Spearman does not disclose use of thermal protection.

Prager describes a lamp socket that includes a fan for cooling a bulb and a second socket that receives the bulb. Prager does not disclose use of thermal protection. Prager does not disclose a trim that encloses a cooling volume separate from a volume of a housing into which the trim is inserted. Prager does not disclose how to exhaust warmed air back into the ambient environment so that it can be cooled. Prager lacks a thermal protector and therefore is not practical for use as recessed lighting in jurisdictions subject to the NEC.

Romano et al. discloses a stage lighting fixture with a 2000-watt xenon lamp. Romano et al. does not disclose a trim that encloses a cooling volume separate from a volume of a housing into which the trim is inserted.

Ivey describes a safety device for a combined fan-light unit. Ivey essentially discloses a motor controller circuit and not a lighting product. Ivey describes using a combination of series/parallel thermal switches to activate a ventilation fan when a given temperature is reached within a combination ventilation fan-light assembly. Ivey does not disclose a trim assembly for use in connection with a recessed lighting housing.

SUMMARY OF THE INVENTION

The foregoing needs and objects, and other needs and objects that will become apparent from the following description, are achieved by the present invention, which comprises, in one embodiment, an actively cooled lighting apparatus for use in conjunction with a first housing that receives a lamp, comprising a second housing comprising an outer wall that fits within and spaced apart from the first housing to thereby define a space between the outer wall and the first housing; a plate mounted to the second housing and having one or more vents that admit to the space; and means for cooling the second housing by drawing a cooling fluid from outside the second housing, through the vents, through the space, and exhausting the cooling fluid around the lamp to outside the second housing.

One feature of this aspect is means, mounted within the second housing, for receiving the lamp. Another feature is that the plate includes a hole through which the lamp protrudes such that the cooling fluid exhausts through a gap between the lamp and the plate. According to one feature, the cooling means is a fan. In another feature, the cooling means is a low-voltage fan that receives supply voltage from a power supply mounted within the second housing. Still another feature provides means in proximity with the second housing for de-energizing the lamp when a temperature about the second housing exceeds a pre-determined value.

According to another feature, the de-energizing means is a thermal protector. A related feature is that the thermal protector may be secured to the second housing adjacent to the lamp. Yet another feature is that the cooling means may be mounted in the second housing to receive cool fluid from outside the second housing and to exhaust the cool fluid to about the lamp. In one embodiment, the first housing may be a ceiling-mounted recessed lighting fixture housing. Another embodiment, further comprises means, removably mounted within the second housing, for receiving one or more lamps. A related feature is that the second housing includes an outer wall having an access window through which the receiving means may be accessed for installation or removal thereof. Another related feature is that the receiving means comprises a removable trim insert that includes one or more lampholders, each of which receives a lamp.

In another embodiment, the fan is a compact DC fan, and the power supply is a compact DC power supply that is coupled in parallel to voltage source that also supplies the lamp. A related feature is that the fan is a compact DC fan, and the power supply is a compact DC power supply that is coupled in parallel to voltage source that also supplies the lamp, and wherein the thermal protector is series coupled in relation to the voltage source and the lamp. Still other embodiments may have a means for receiving a relatively elongated lamp, and an extender section secured to the second housing that encloses the relatively elongated lamp.

In yet another embodiment, the cooling means is a fan that receives supply voltage from a power supply mounted on the first housing. Another embodiment provides at least one step-down transformer that supplies reduced voltage to at least one of the lamps.

A related feature provides a plurality of step-down transformers mounted within the second housing, wherein each of the transformers supplies reduced voltage to one of a plurality of lamps mounted on the trim insert.

According to another feature, the apparatus further comprises a second means for receiving a lamp mounted within the second housing; an adapter secured in the second means for receiving a lamp and electrically coupled to the means, removably mounted within the second housing, for receiving one or more lamps to thereby supply voltage to the lamps. The apparatus may further comprise an eyeball apparatus that is tiltably mounted in the second housing, the eyeball apparatus including a trim ring having at least one intake vent disposed therein and a mounting plate having at least one exhaust vent disposed therein.

According to another feature, there is means in the second housing for receiving an A-type lamp; and a reflector that is mounted in the second housing to downwardly reflect light from the A-type lamp. A related feature provides means in the second housing for receiving a fluorescent lamp; and a fluorescent lamp ballast in the second housing and coupled to receive supply voltage therefrom and provide starting voltage to the fluorescent lamp.

Thus, in one embodiment, an actively cooled recessed lighting trim apparatus comprises a trim housing that fits within a standard recessed lighting fixture housing to define a space between the lighting fixture housing and the trim housing; a trim ring or face that has a vent for admitting a cooling fluid to the space; and a means for actively cooling the space or the trim housing. The space between the outer standard fixture housing and the inner trim forms a low-pressure plenum through which a cooling fluid is circulated. A thermal protector may be secured within the trim housing to turn off a lamp in the housing if the internal temperature of the space, or of the trim housing, becomes too hot. The cooling means, which may be a fan, actively draws a cooling fluid in through the vent of the trim ring, over the trim housing and the illuminated lamp, and exhausts warmed cooling fluid out though gaps between the lamp and the trim ring. Accordingly, high-wattage lamps may be used safely in recessed lighting installations. In one embodiment, the trim uses a high-wattage PAR-type lamp, either metal halide or incandescent, and may be installed in either an insulation-contact (IC) or non-IC housing.

According to another aspect, the invention provides an actively cooled lighting apparatus for use in conjunction with a lighting fixture having a first housing, comprising a trim housing mounted within the first housing and spaced-apart therefrom to thereby define a space between the trim housing and the first housing; means mounted in the trim housing for receiving a lamp and spaced apart from the trim housing to thereby define a gap between the lamp and the trim housing when the lamp is mounted therein; and means for cooling the trim housing by drawing a cooling fluid from outside the trim housing, through the space, and exhausting the cooling fluid over the lamp through the gap to outside the trim housing.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2D is a side elevation part sectional view of another embodiment of an actively cooled trim apparatus;

FIG. 2E is a top plan view of an aperture plate of the embodiment of FIG. 2D;

FIG. 5C is a top plan view of a socket plate;

DETAILED DESCRIPTION OF THE PREFERRED EMBODIMENT

A fan-cooled lighting apparatus is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

FAN-COOLED TRIM

Figure 1A:
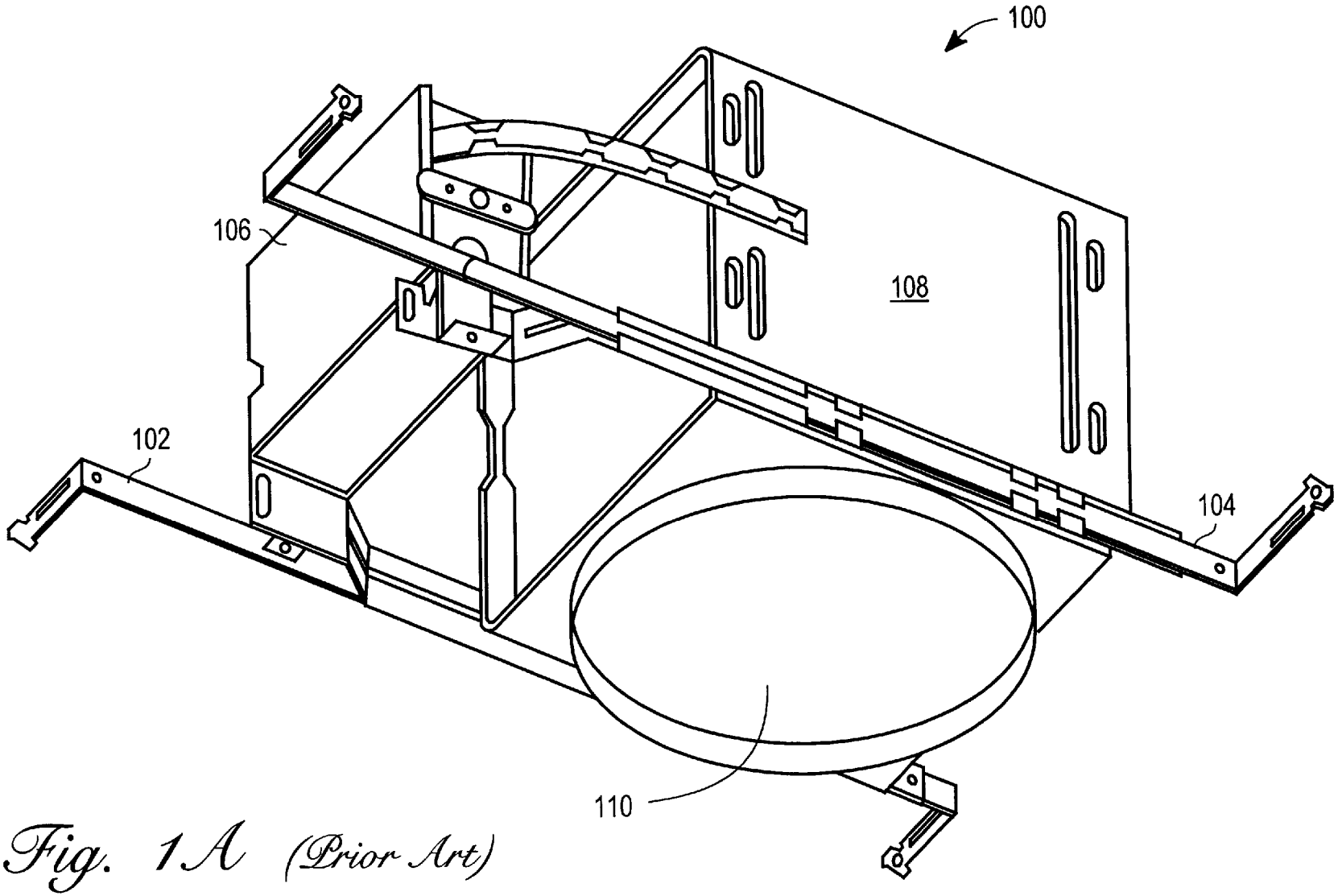
Fig. 1A (Prior Art)
FIG. 1A (prior art) is a perspective view of a housing for a recessed lighting fixture.

In one embodiment, a fan-cooled trim is provided for installation into a recessed lighting housing such as housing 100 of FIG. 1A.

Housing and Mechanical Elements

Figure 1B:
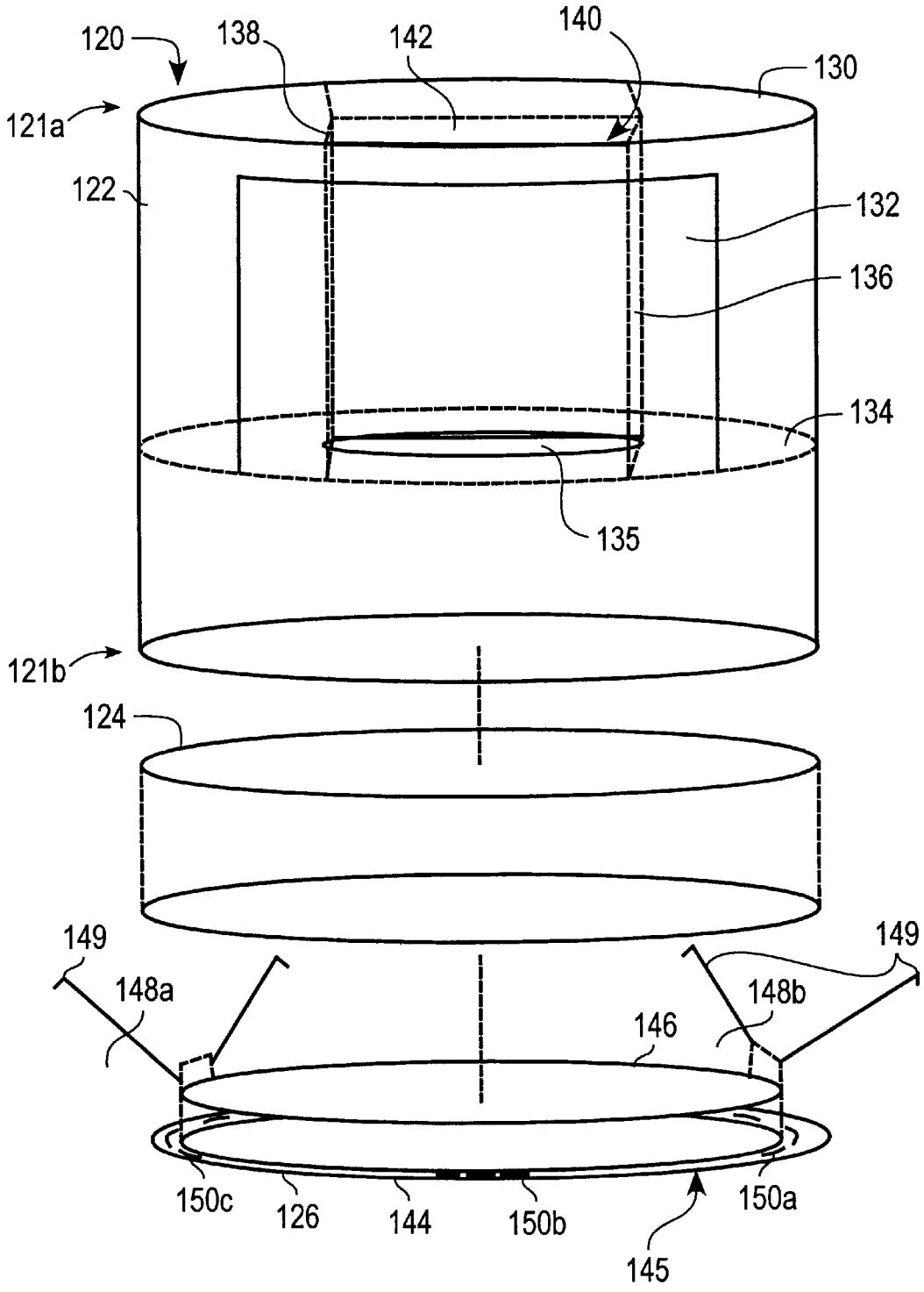
FIG. 1B is an exploded perspective view of a trim.

FIG. 1B is an exploded perspective view of a trim according to one embodiment. The trim comprises a trim housing 120, one or more optional extender rings 124, and a bottom trim ring 126. In the preferred configuration, trim ring 126 projects slightly downwardly into a room or other area that is lit, and a lamp (not shown in FIG. 1B) directs light through trim ring 126 downwardly into the area that is lit.

Trim housing 120 may comprise a generally cylindrical outer wall 122 made of sheet metal, or other suitable material, and to which other parts of the trim housing are secured. The wall 122 may be formed as a single piece or as two or more pieces joined together as a unit. The upper end 121*a* of trim housing 120 is closed by generally circular top plate 130 whereas the lower end 121*b* is open so that a lamp may protrude downwardly through it. The diameter of outer wall 122 is from slightly less to substantially less than the interior width of the housing 100. Accordingly, when trim housing 120 is mounted within box 108 of housing 100, a low-pressure plenum or closed volume of airspace is defined between outer wall 122 and the inside surfaces of walls of box 108.

A generally circular baffle plate 134 is secured within the outer wall 122 approximately midway between upper end 121*a* and lower end 121*b*. Baffle plate 134 has a generally circular central hole 135 through which the neck of a lamp may protrude. Affixed to the upper surface of baffle plate 134 and to the inside surface of outer wall 122 are plates that together define two separated generally cubic compartments within the trim housing 120. A fan mounting plate 136 is vertically affixed to the baffle plate 134 outward of the central hole 135. A socket adapter plate 138 similarly is vertically affixed to the baffle plate 134 outward of the central hole 135 and opposite the fan mounting plate 136. A generally rectangular separator plate 142 is vertically secured to baffle plate 134 rearward of and tangential to the central hole 135; the left and right vertical edges of the separator plate are secured, respectively, to socket adapter plate 138 and fan mounting plate 136. A top plate 130 is secured to the top edges of the fan mounting plate 136, socket adapter plate 138, and separator plate 142 to join the plates together and form a rigid pair of compartments. When these elements are assembled the top plate 130 rests underneath and immediately against top wall 121*a* of trim housing 120. Outer wall 122 has one or more generally rectangular cutouts or holes 132 that provides access to components mounted within the trim housing 120. In the preferred embodiment, one hole.

A socket plate 141, having a right-angle bend, is secured to baffle 134 to provide a mounting surface for socket 172, which is described further below.

Plates 136, 138, 140, 141, 142 may be formed integrally or as separate pieces. In the preferred embodiment, plates 136, 138, 140, 141, 142 form an internal bracket structure that comprises three (3) sheet metal pieces, which may be assembled as a unit and then dropped into housing 120 as one unit. The plates form integral wiring compartments, thereby separating wiring elements from one another.

Figure 2A:
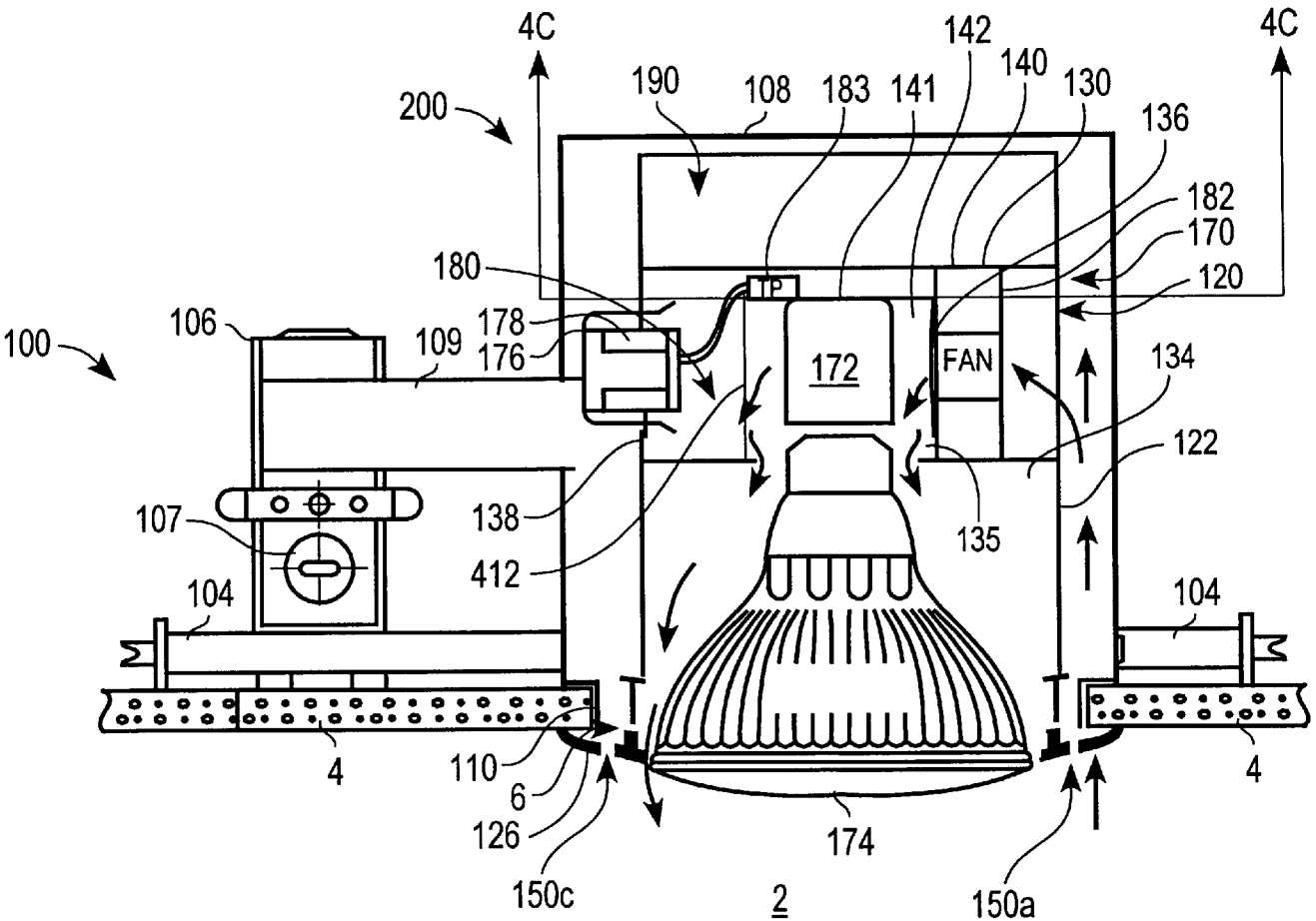
FIG. 2A is a side elevation part sectional view of an embodiment of an actively cooled trim apparatus.
Figure 4A:
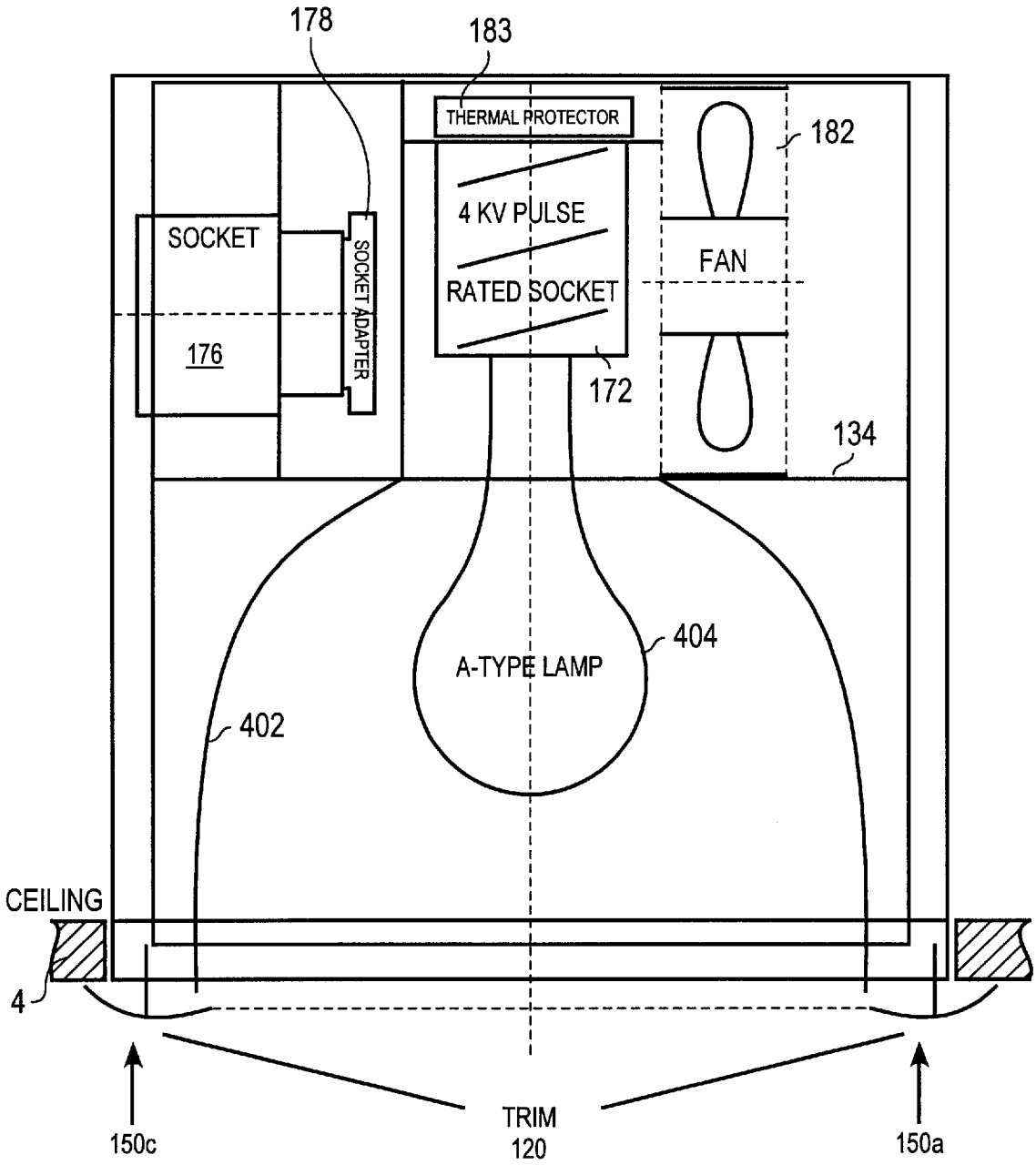
FIG. 4A is a side elevation part sectional view of another embodiment of an actively cooled trim apparatus.
Figure 4B:
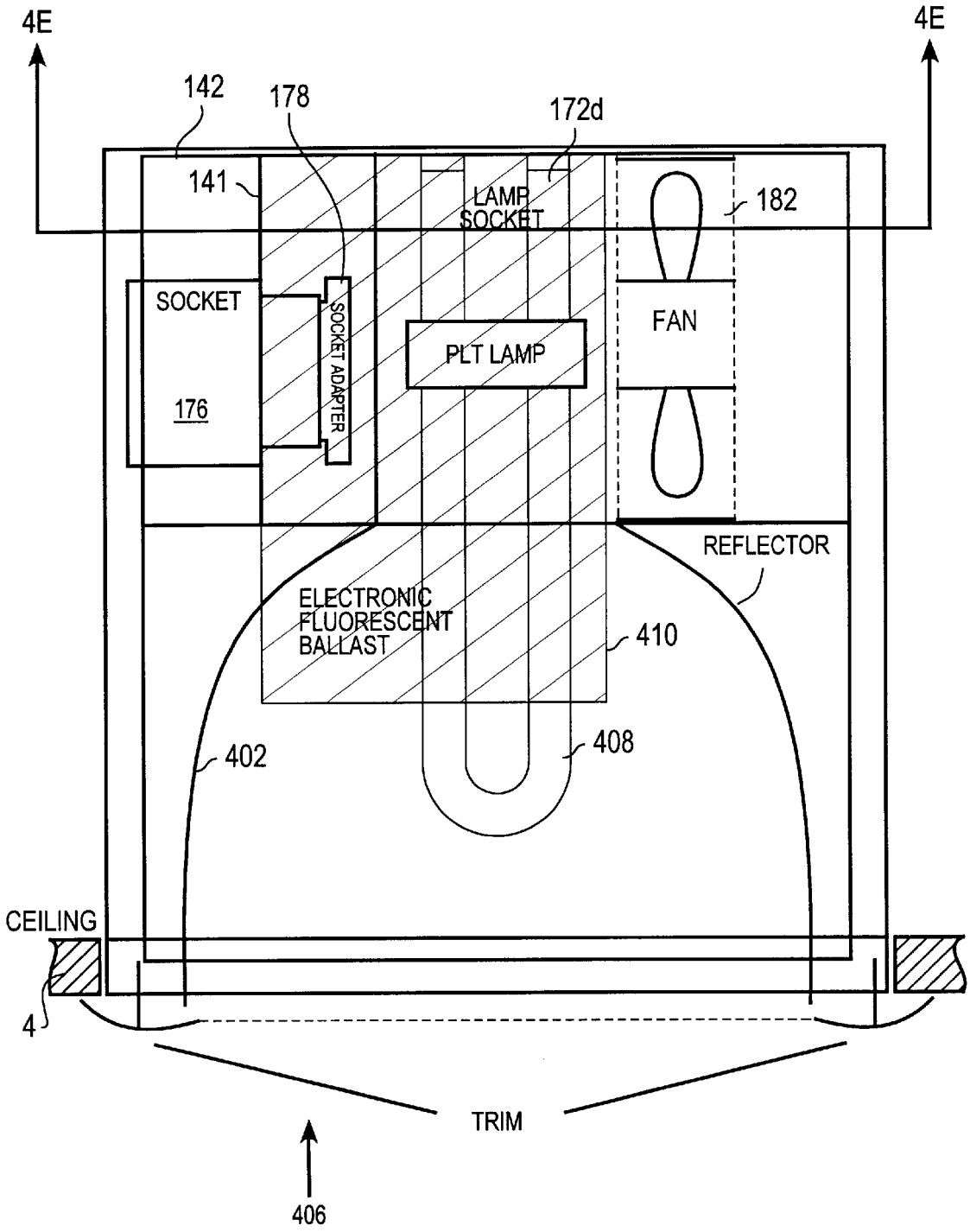
FIG. 4B is a side elevation part sectional view of another embodiment of an actively cooled trim apparatus.
Figure 4C:
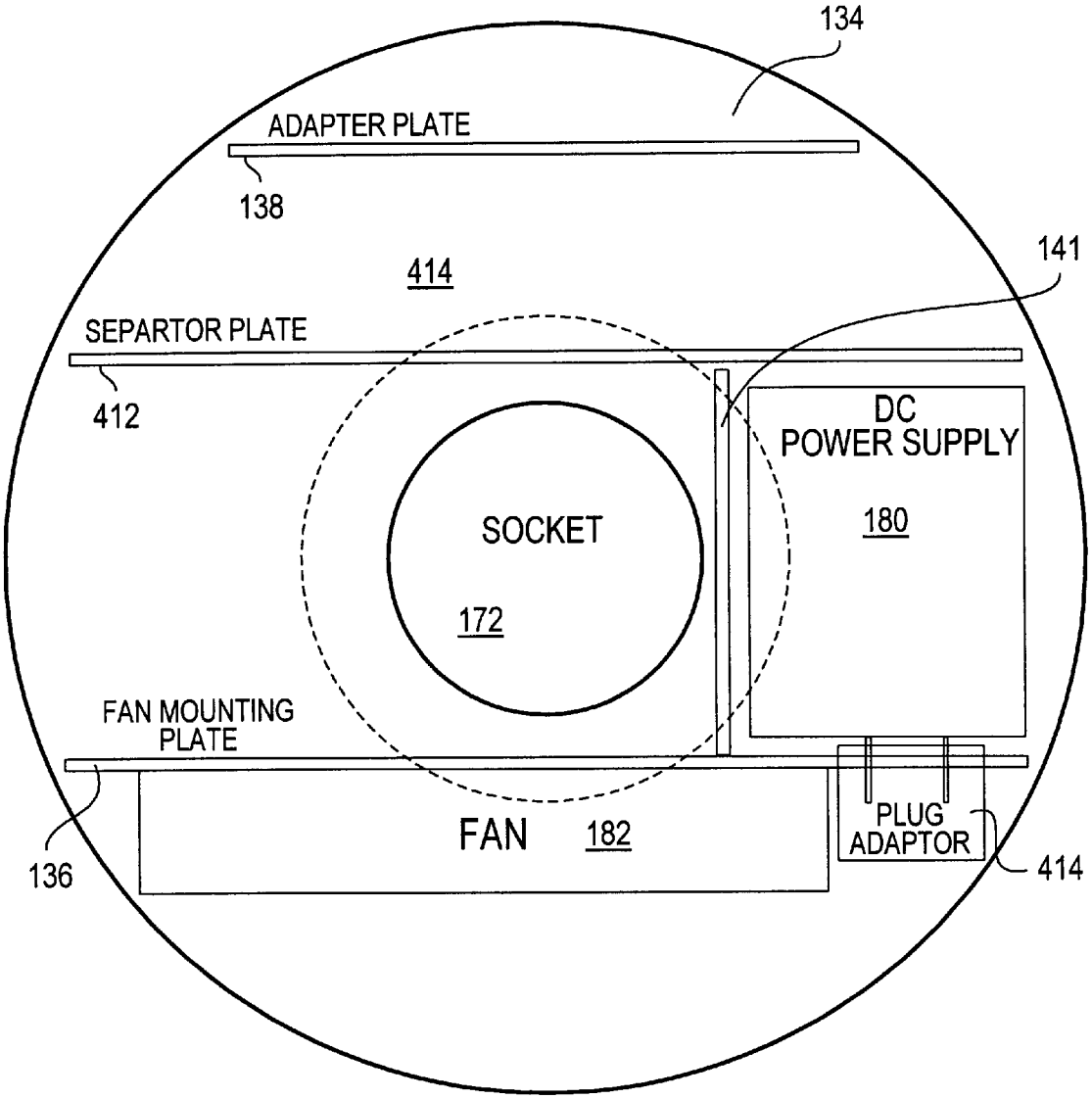
FIG. 4C is a top plan part section view of a trim taken along line 4C of FIG. 2A.

FIG. 4C is a top plan view of trim 120 taken along section line 4C—4C of FIG. 2A showing further details of assembly 200 including the spatial relationship of plates 136, 138, 141, 142. In certain embodiments, a second separator plate 412 provides additional structural strength for assembly 200 and also defines a wiring compartment within which wiring from socket adapter 178 may be routed. FIG. 4C also shows the arrangement of power supply 180 and plug adapter 414.

One or more generally cylindrical extender rings 124 may be secured to the lower end 121*b* of housing 120 to extend the length of the housing 120. This enables housing 120 to accommodate longer or larger lamps.

Trim ring 126 comprises a generally ring-shaped lower wall 144 joined to a short upstanding cylindrical wall 146 that provides rigidity and which slips snugly into the bottom end 121*b* of housing 120, or into one of the extender rings 124. Lower wall 144 and cylindrical wall 146 have a hole 145 extending through them so that light projected by a lamp in the trim is directed downward and out of the trim. One or more torsion springs 148*a*, 148*b* are secured to the perimeter of the wall 146. When the trim ring 126 is slipped into the bottom end 121*b* of housing 120, end hooks 149 of springs 148*a*, 148*b* engage bosses, tabs, or holes in the outer wall 122 and releasably lock in place, thereby holding the trim ring tightly within and against the outer wall 122.

Lower wall 144 further includes one or more air vents 150*a*, 150*b*, 150*c* disposed about the perimeter of the lower wall. Each air vent may comprise a hole or slot in the lower wall 144. To improve the aesthetic appearance of the trim 120, the air vents 150*a*–150*c* may be cut in groups of multiple slots, or in an evenly spaced-out arrangement. When the trim 120 is mounted within box 108 of housing 100, the air vents 150*a*–150*c* provide a means of air intake to, and air exhaust from, the low-pressure plenum or airspace that is defined between the outer wall 122 and the inside surface of walls of box 108.

In certain embodiments, lower wall 144 is omitted and a cooling fluid is drawn directly into the low-pressure plenum that is defined between the outer wall 122 and the inside surface of walls of box 108.

In this configuration, the trim 120 can be installed or substituted for other trims in any standard recessed lighting housing 100 without any modification of the housing.

Fan and Other Active Elements

FIG. 2A is a side elevation section view of an embodiment of a lamp cooling assembly 200 that includes the trim 120 of FIG. 1B mounted in a housing 100 as shown in FIG. 1A. The assembly 200 of FIG. 2A is just one example of a lamp cooling assembly that can be made using the trim 10; many other embodiments are contemplated and are possible, as described further below.

In assembly 200, housing 100 is secured by arm 104 and arm 102 (not shown in FIG. 2A) to ceiling members 4 such that open end 110 of box 108 protrudes slightly downwardly through a hole 6 in the ceiling. Trim 120 is secured within box 108 so as to define a space 170 that acts as a low-pressure plenum or airflow region.

A lampholder 172 or lamp socket is secured to socket mounting bracket 141, or alternatively, to top plate 140 so that the open end of the lampholder faces downwardly. An example of a suitable lampholder is the Leviton N-3 No. 8756 4 KV pulse rated porcelain socket. A lamp 174 may be secured in the lampholder, for example, by screwing the lamp into the lampholder. In this configuration, in operation, the lamp 174 directs light downwardly into the room 2 or other space that is lit. Heat generated by lamp 174 tends to propagate upward by convection so as to warm the lampholder 172, the trim 120, and components of the trim.

Electrical power is supplied to the assembly 200 by external wiring typically provided in a conduit (not shown in FIG. 2A) that is secured to a conduit knockout or hole 107 of junction box 106. The external wiring is joined within the junction box 106 to supply wiring that is routed through or mechanically secured to a wireway 109, and which terminates at a standard medium base socket 176. The socket 176 is a standard component of off-the-shelf housings 100. Supply voltage is coupled from the supply wiring to internal components of the trim 120 by a medium base socket adapter 178 that is screwed into the socket 176, which clips into the trim. An example of a suitable socket adapter is the Leviton K-39 No. 165 phenolic flanged adapter. Use of socket 176 and socket adapter 178 is not required; any other convenient means of conducting supply voltage from a supply source to the internal components of trim 120 may be used, such as wire, quick-disconnect connectors, and other connectors.

Leads extending from the socket adapter 178 are connected to a convenience outlet 414 (not shown in FIG. 2A, shown in FIG. 4C) that is mounted within trim 120, for example, by being affixed to plate 142 or plate 138. In one embodiment, a compact DC power supply, such as a plug transformer type of supply (not shown in FIG. 2A), is plugged into the convenience outlet to receive supply voltage from it. Low voltage DC is produced as output by the power supply.

A fan 182 is secured within trim 120 to fan mounting plate 140 upon baffle 134. Fan 182 preferably is a compact low-voltage DC fan of the type commonly used for internal cooling of personal computers. Fan 182 receives DC supply voltage from the DC power supply and, in operation, actively cools the trim 120. As shown in FIG. 2A, fan 182 is mounted so as to draw ambient atmosphere or air from room 2, through vents 150*a*–150*c*, and into and through space 170. Fan 182 exhausts the air toward the lamp socket 172 and over lamp 174. Warmed exhaust air exits trim 120 through gaps 184, which arc located between the perimeter of the lamp 174 and hole 145 of trim ring 126. Thus, in this configuration, the fan draws ambient air from the room, blows the air through an inner trim housing, and exhausts the warmed air through the lamp aperture. Importantly, the exhaust air is warmed only after exiting fan 182. Examples of suitable fans are the Orion Fans model OD 8025 DC fan, or the model OA 825 AC fan, both commercially available from Knight Electronics.

Leads extending from the socket adapter 178 also are connected to a thermal protector 183 that is affixed to socket mounting bracket 141, such that the thermal protector is coupled in series with the supply voltage to the trim 120. Thermal protector 183 may be mounted in an appropriate protective housing (not shown). In this configuration, when the trim 120 reaches an unacceptably high predetermined temperature as a result of heat generated by lamp 174, thermal protector 183 will trip or de-energize the circuit, thereby shutting off the lamp and cooling the trim. In an alternate embodiment, thermal protector 183 is affixed to an inside surface of the housing 122 of the trim 120, for example, on the inside surface of top plate 130. It is anticipated that the thermal protector will activate only when the fan fails. Alternatively, the thermal protector could activate if the intake air path is blocked, or if the air exhaust path is blocked, or if a lamp that exceeds the maximum rated wattage of the lamp is installed. An example of a suitable thermal protector is model 7AM, commercially available from Texas Instruments Inc., Motor Controls Marketing, Attleboro, Mass.

Housing 100 may have a second, separate thermal protector. The thermal protector 183 of trim 120, however, operates separately because space 170 forms a separate air volume. By providing indepcndent thermal protection for this smaller, hotter volume, the thermal protector 183 will turn the lamp 174 off quickly if the fan 182 fails.

In this configuration it may be seen that the assembly comprises a lamp mounted in the trim housing to direct illumination outwardly of the trim housing, and spaced apart therefrom to thereby define a gap between the lamp and the trim housing. A cooling fluid may be drawn in by thc fan into the plenum, warmed as it passes over mechanical elements of the assembly and the lamp, and exhausted through the gap to the ambient atmosphere, thereby cooling the lamp and the assembly.

A fan-cooled trim thus has been described. By actively cooling the fixture, a tremendous increase in lamp wattage can be realized within a recessed lighting fixture. The expected mean time between failures of the fan is over 70,000 hours, or approximately 8 years of continuous operation. The fan life may be further increased by operating the fan at less than its rated voltage.

In one alternative embodiment, a variable voltage DC power supply operates the fan. The variable DC power supply is set to provide a voltage output that is less than the maximum rated voltage of the fan, but that operates the fan at a speed sufficient to cool the lamp. By using a variable DC power supply, when operating lower wattage lamps, the fan's speed is further reduced, which further reduces fan noise. Suitable variable voltage DC power supplies are widely available from electronics parts dealers. A suitable type of supply is a plug transformer that accepts 120 volts AC input and provides a selectable output of 3, 4, 5, 6, 7.5, 9, or 12 volts DC. In yet another alternate embodiment, acoustic insulation is affixed to the exterior of the trim housing to further dampen any remaining fan noise.

In operation, the trim may create minor negative pressure or suction with respect to the recessed lighting fixture housing. As a result, dust or dirt may be drawn from the ceiling area into the trim and exhausted around the exterior of the light fixture. This may possibly cause staining or dust buildup on the portion of the light fixture that is visible within the room that is illuminated. To address this problem, in still other alternate embodiments, the recessed lighting fixture housing is sealed using tape or a similar material, or a sealed fixture housing is used, or a separate anti-air-infiltration liner is affixed to the fixture housing.

DIFFERENT LAMP TYPES AND ALTERNATIVE EMBODIMENTS

Lamps suitable for the embodiments disclosed in this document are described in Lamp Specification and Application Guide, commercially available from Philips Lighting Company, Somerset, N.J.

In the embodiment of FIG. 2A, lamp 174 is a PAR-38 type floodlamp. However, many other lamp types are contemplated and may be used. For example, a metal halide electronic ballast may be affixed in space 190 and electrically coupled to receive supply voltage from socket 178 and provide output voltage to lamp 174. In this configuration, lamp 174 may be a metal halide lamp. Further, the trim can be changed by the end user from metal halide to incandescent and back to metal halide by installing or removing the ballast one or more times. Suitable electronic ballast products are commercially available from Aromat.

Figure 2B:
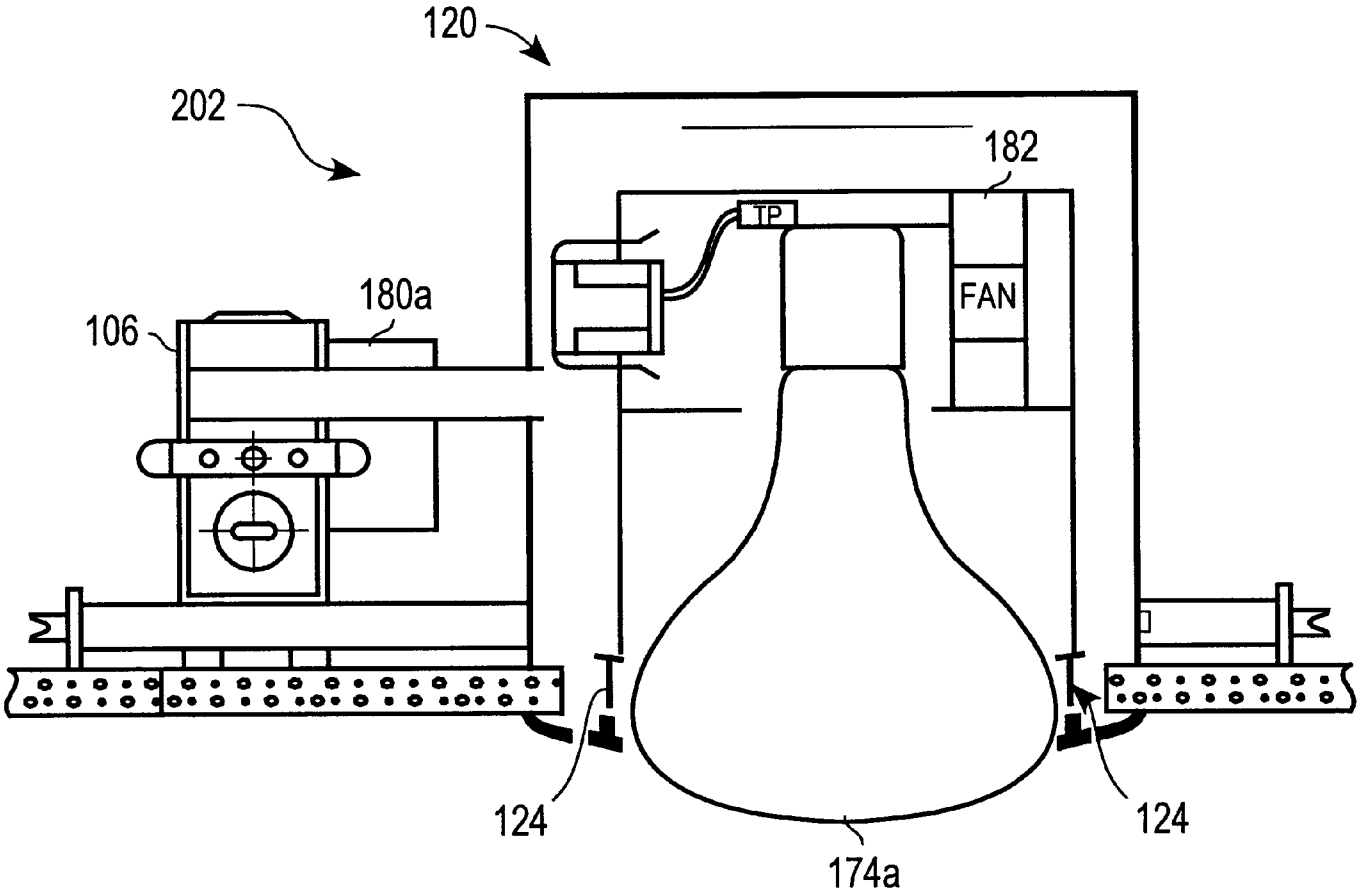
FIG. 2B is a side elevation part sectional view of another embodiment of an actively cooled trim apparatus.

FIG. 2B is a side elevation sectional view of a second embodiment of a lamp cooling assembly 202 that accommodates an incandescent type R-40 lamp 174*a*. No ballast is used. The housing 122 is lengthened by affixing a spacer ring 124 to the open end of the trim 120. The spacer ring 124 comprises a generally short cylindrical ring made of sheet metal or the like. Spacer ring 124 is affixed to the trim housing 122 using any appropriate fasteners such as screws or spring clips. When so lengthened, an R-40 lamp is accommodated.

The embodiment of FIG. 2B may accommodate an R-40 lamp of high wattage, such as 250 watts, 300 watts, or 500 watts. In another alternative embodiment, fan 182 is a high-current DC fan, or fan 182 is an AC fan. In this embodiment, space 180 may be too small to accommodate a power supply of sufficient size to power the fan. Therefore, a power supply 180*a* for the fan 182 is optionally secured to the junction box 106 of housing 100. In this configuration, a larger power supply may be used to supply higher current or voltage to the fan 182, thereby providing greater cooling capacity for high wattage lamps. Alternatively, power supply 180*a* may be mounted onto a removable end wall panel of housing 100.

Figure 2C:
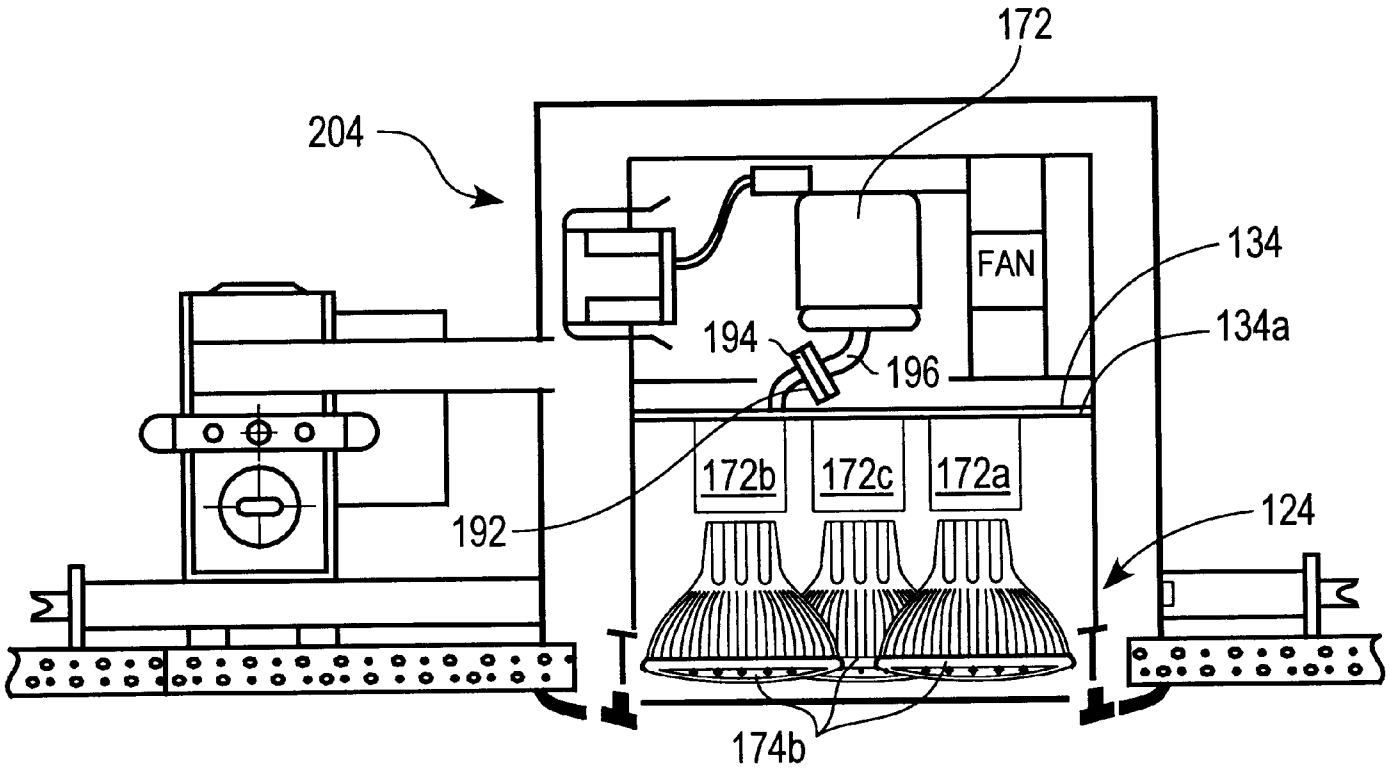
FIG. 2C is a side elevation part sectional view of another embodiment of an actively cooled trim apparatus.

FIG. 2C is a side elevation sectional view of a lamp cooling assembly 204 that accommodates three type PAR-16 lamps 174*b*, which may be rated, for example, at 60 watts each. Three lampholders 172*a–c* or sockets are affixed to a trim insert 134*a* or, alternatively, directly to baffle plate 134. Each lampholder 172*a–c* is wired in parallel to the supply voltage. Wires 192 which supply voltage and are coupled to the lampholders 172*a–c*, may be coupled by a quick-disconnect connector 194 to a socket adapter 196, which in turn is screwed into the lampholder 172 of the trim 120. Using this configuration, the PAR-16 lamps 174*b*, lampholders 172*a–c*, and the trim insert 134*a* may be rapidly and easily removed from the trim 120 by disconnecting the connector 194 and sliding them out of the trim 120.

In another alternative embodiment, trim 120 includes a telescoping spacer ring assembly that may be selectively extended or retracted to accommodate a larger or smaller lamp.

In another alternative, the trim housing 122 is made in a more elongated form to accommodate a larger lamp without the need for a spacer ring 124.

FIG. 2D is a side elevation sectional view of an embodiment of an assembly 206 that accommodates three (3) type MR-16 low-voltage halogen lamps 174*c*. Each of the lamps 174*c* is affixed in a downwardly facing orientation to a generally circular aperture plate 210. FIG. 2E is a top plan view of the aperture plate 210. The aperture plate 210 has three (3) generally circular apertures 212 through which lenses of the lamps 174*c* project. The aperture plate 210 is affixed along its perimeter to the inside surface of the lower end of trim housing 122. Three transformers 208 are secured within trim 120. Each of the transformers 208 provides a low voltage output to one of the lamps 174*c*. A separate power supply 180*b* is mounted on junction box 106 and provides low voltage DC or AC to fan 182.

Figure 2F:
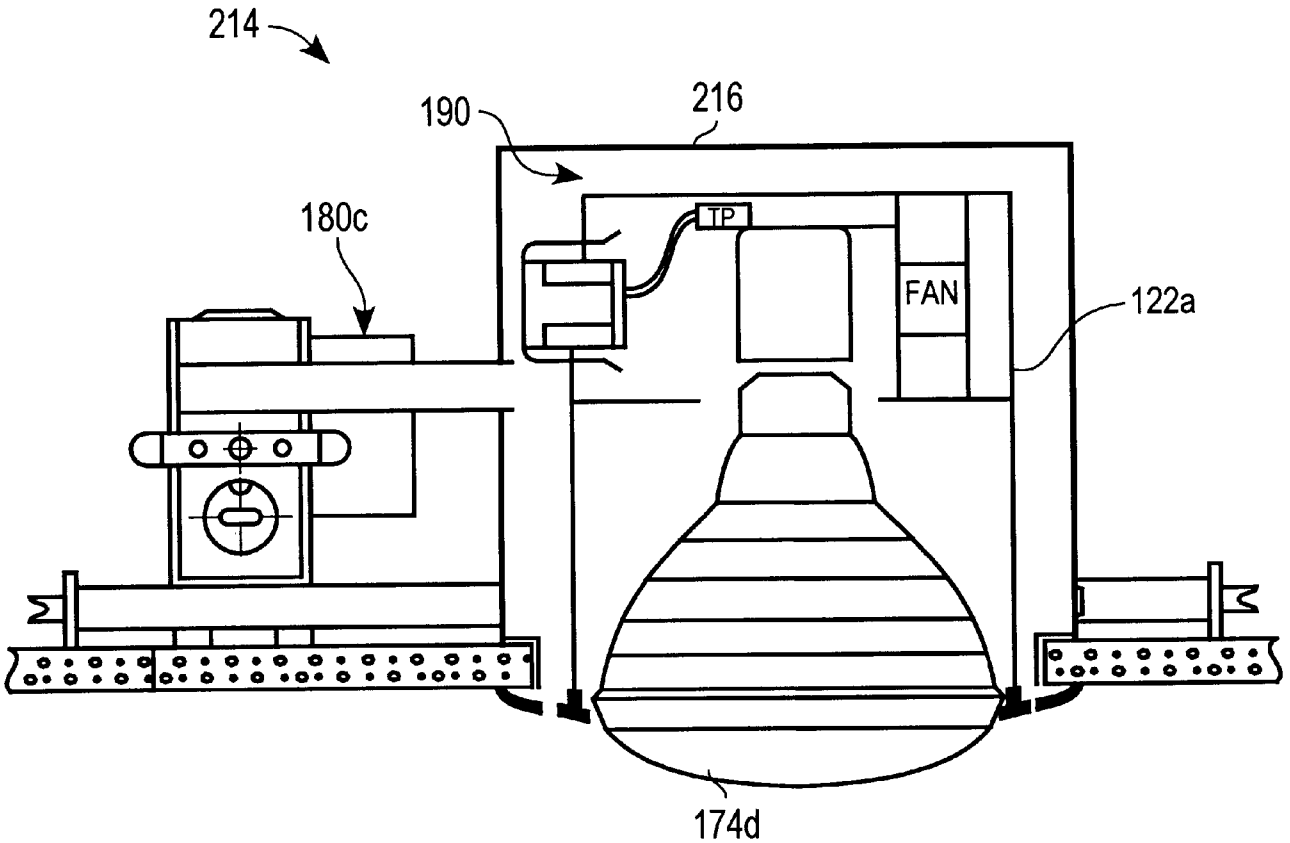
FIG. 2F is a side elevation part sectional view of another embodiment of an actively cooled trim apparatus.

FIG. 2F is a side elevation sectional view of an embodiment of an assembly 214 that uses a low-profile housing 216. An example of a suitable low-profile housing is model IBX6, which is commercially available from Prescolite, Inc., of San Leandro, Calif. This type of enclosure is intended for installation between 2×6 joists or in other situations in which the enclosure must fit in a recess that is approximately six (6) inches high or deep.

In this embodiment, a vertically shorter trim housing 122*a* is affixed within the housing 216, and space 190 is substantially reduced in vertical height. This embodiment accommodates, nevertheless, a full-sized floodlamp 174*d*, such as a type PAR-38 incandescent floodlamp.

Figure 2G:
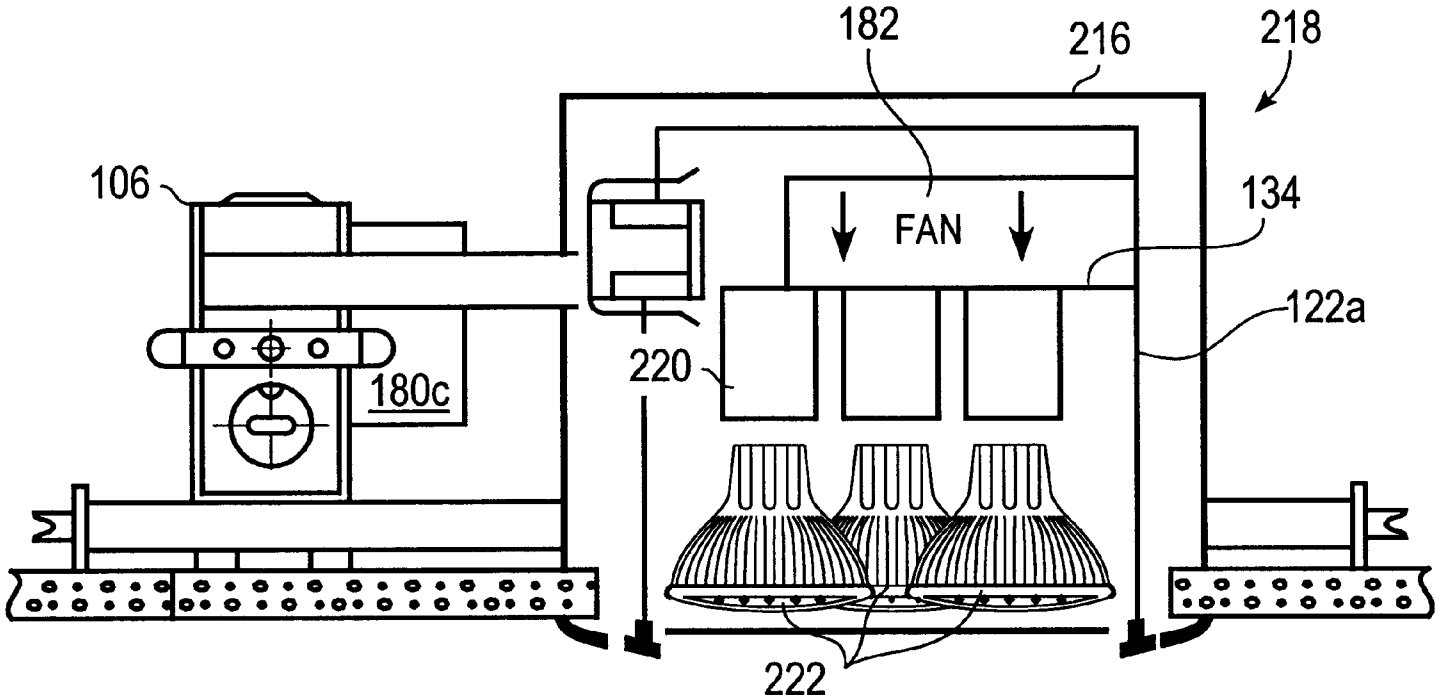
FIG. 2G is a side elevation part sectional view of another embodiment of an actively cooled trim apparatus.

FIG. 2G is a side elevation sectional view of an embodiment of an assembly 218 that accommodates three (3) 50-watt PAR-20 type lamps or three (3) 60-watt PAR-16 lamps in a low-profile housing 216. Type K-19 lamps are also accommodated. In this embodiment, the housing 216 is an IBX-6 housing of the type shown in FIG. 2F. The trim housing 122*a* is of the vertically shorter type as shown in FIG. 2F. Fan 182 is mounted horizontally within trim housing 122*a*, for example, on baffle 134, which is provided with appropriate apertures for drawing in and exhausting air. Also mounted to baffle 134 are three (3) lampholders 220 or sockets, each of which receives one of three (3) lamps 222. A power supply 180*c* is mounted on junction box 106 and supplies low voltage power to fan 182.

In this configuration, an IBX-6 type enclosure may receive three (3) fan-cooled lamps.

Figure 2H:
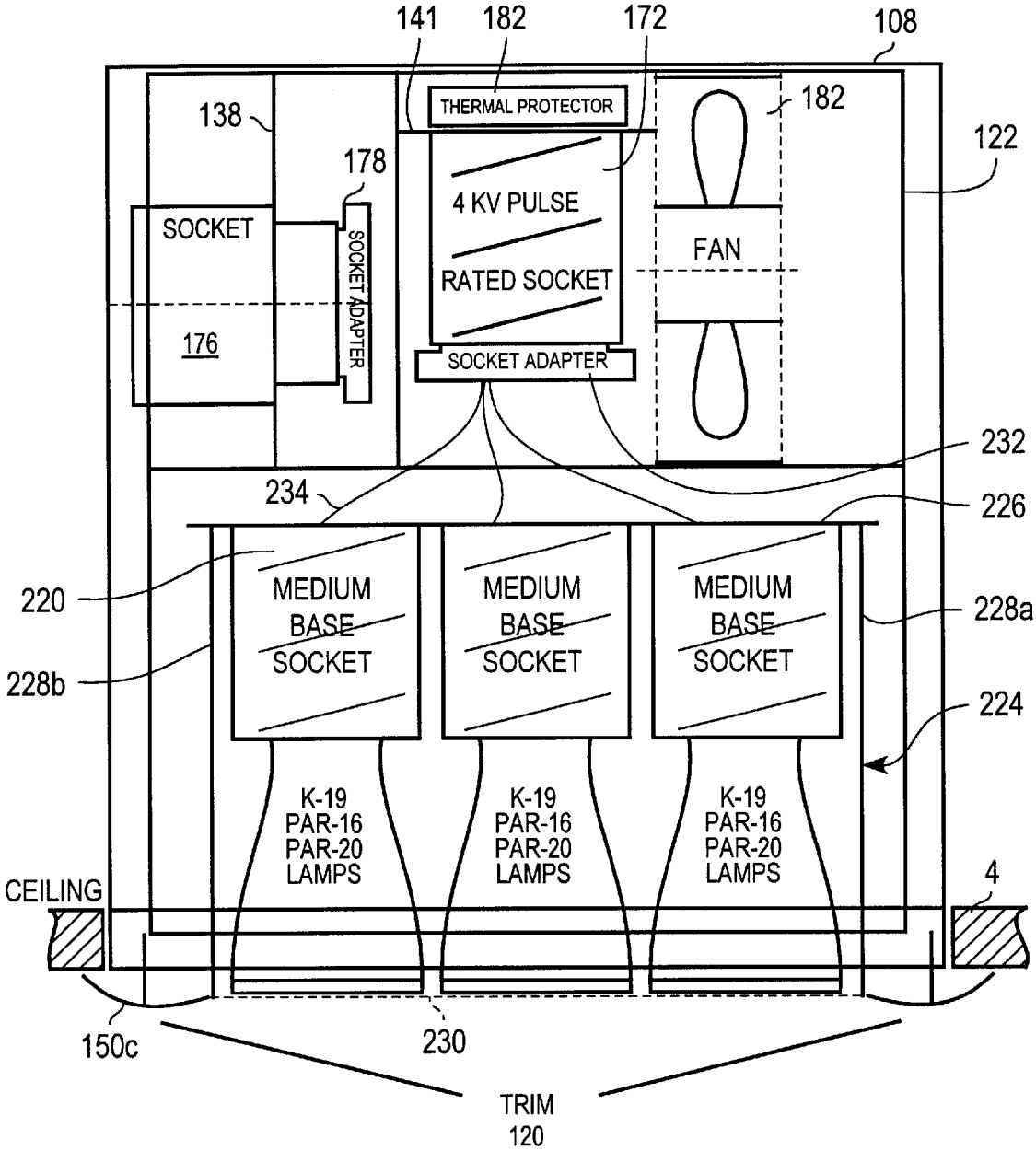
FIG. 2H is a side elevation part sectional view of another embodiment of an actively cooled trim apparatus.

FIG. 2H is a side sectional elevation view of an alternative embodiment of a trim 120 that accepts three type PAR-16, PAR-20, or K-19 lamps in a removable trim insert 224, which comprises socket mounting plate 226, and first and second separator support brackets 228*a*, 228*b*. In a further alternative, when PAR-16 lamps are used, trim insert 224 further includes an aperture plate 230. Socket mounting plate 226 and support brackets 228*a*, 228*b* are sheet metal components that may be secured to form a unit, by welding, by tabs that engage slots, or by other suitable fastening means. Alternatively, socket mounting plate may be mounted directly to baffle plate 134. Lampholders 220 are secured to socket mounting plate 226. To supply power to lampholders 220, a socket adapter 232 is screwed into socket 172. Wires 234 extend from socket adapter 232 to the lampholders 220. Use of socket adapter 232 is not required, but advantageously enables the trim insert 224 to be removable.

Trim insert 224 slides into and is fixed in place within trim 120 by suitable fasteners such as clips, screws, or locking tabs. In this configuration, trim insert 224 may be added to the trim at any time by the end user. The trim insert is reversible. The trim insert thus provides great variation in the types of lamps that can be installed in the trim.

OTHER FIXTURE CONFIGURATIONS

Figure 3:
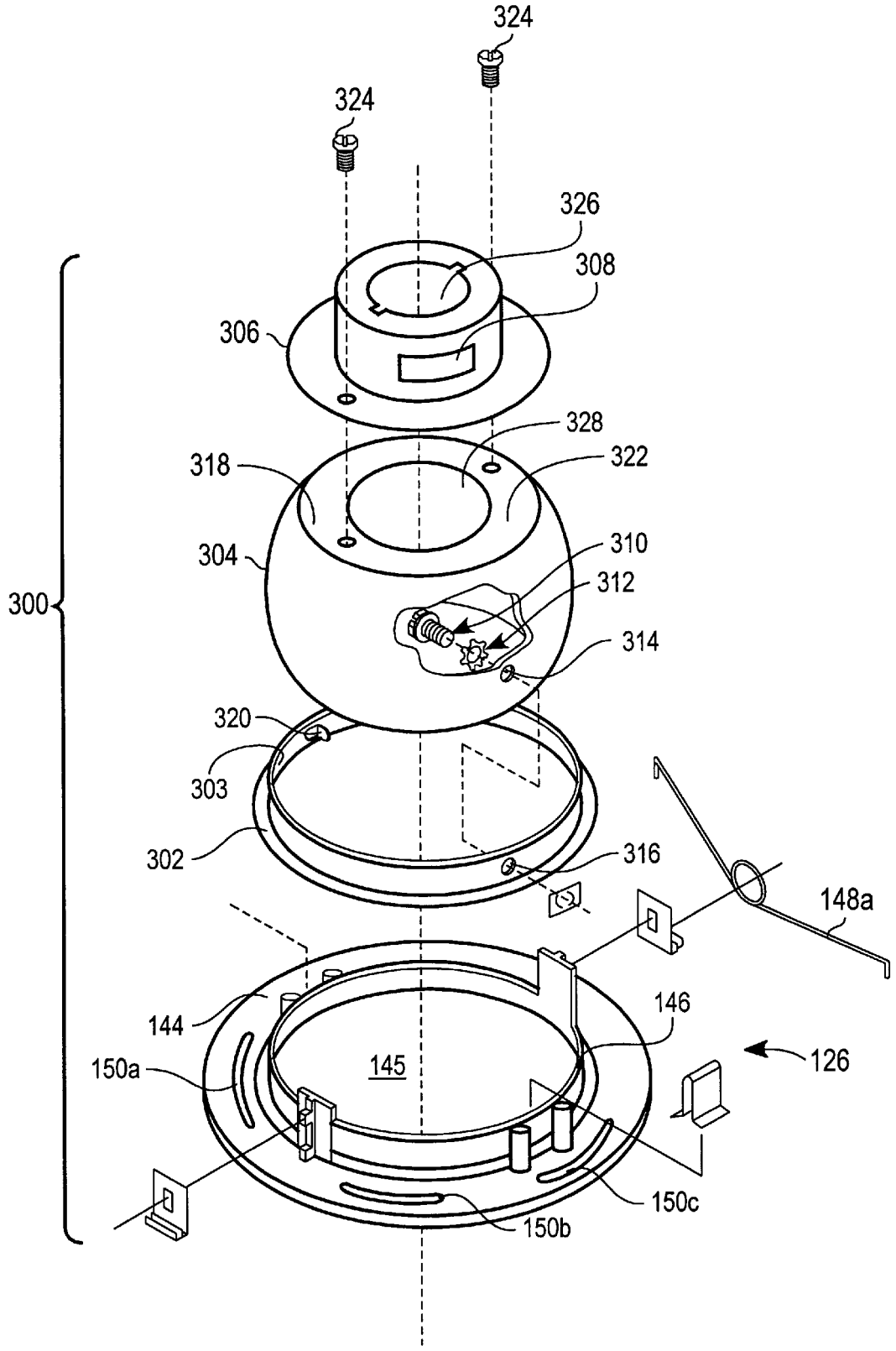
FIG. 3 is an exploded perspective view of an eyeball trim apparatus.

FIG. 3 is an exploded perspective, part section view of an adjustable "eyeball" trim assembly 300 that may be used in certain embodiments. Assembly 300 generally comprises a trim ring 126, mounting ring 302, eyeball 304, and upper plate 306.

The trim ring 126 may have the same configuration as shown in FIG. 1B. Vents 150*a*–150*c* may be formed as generally arcuate slots, as shown in FIG. 3. Wall 146 of trim ring 126 is secured to mounting ring 302. Eyeball 304 fits snugly in mounting ring 302 against the inner face 303 thereof, for forward and backward rotation within the mounting ring. Eyeball 304 is rotatably secured within the mounting ring 302, on one side, by a screw 310, the shaft of which is mounted through hole 314 of the eyeball and hole 316 of the mounting ring, and fixed in place by lock washer 312. Hole 316 is threaded to securely receive the screw 310. The opposite side of the eyeball 304 has a hole 318 diametrically opposite hole 314 that engages and rotatably rides on an inwardly protruding tab 320 of mounting ring 302. In this configuration, the eyeball 304 may tilt backwards and forwards within the mounting ring.

Upper plate 306 is secured to the top surface 322 of eyeball 304 by one or more screws 324 or other fasteners. The neck of a lamp may protrude through hole 326 of the upper plate 306. At least one vent 308 is disposed in a wall of the upper plate 306. A cooling fluid, such as ambient air, blows through the fan, into vent 308, into eyeball 304, and out hole 145. The neck or body of the lamp also protrudes through hole 328 of eyeball 304 so that light is directed downward through hole 145 of trim ring 126.

In this configuration, a fan-cooled eyeball lighting fixture is provided. The eyeball fixture may be installed in or retrofit to a recessed lighting housing.

FIG. 4A is a side elevation sectional view of a fan cooled trim assembly 400 according to another alternate embodiment. Assembly 400 includes a generally dome-shaped reflector 402 that is secured to the downward facing face of baffle plate 134. In this configuration, the assembly 400 accommodates an A-type lamp 404.

FIG. 4B is a side elevation sectional view of a fan cooled trim assembly 406 according to yet another alternate embodiment. Assembly 406 also includes a reflector 402 of the type shown in FIG. 4A. A lamp socket 172*d* is mounted in the trim 120 to receive a fluorescent lamp 408, for example, a 42-watt recessed fluorescent lamp. Power is supplied to the lamp 408 by a compact electronic fluorescent ballast 410 that is secured within trim 120, for example, to top wall 142. Socket 172*d* may be of type PLT. Ballast 410 receives supply voltage from wiring secured to socket adapter 178 and coupled to socket 176. In this configuration, the trim 120 accommodates a recessed fluorescent lamp. Suitable fluorescent ballast products are commercially available from Energy Savings of Schaumburg, Ill.

Figure 4D:
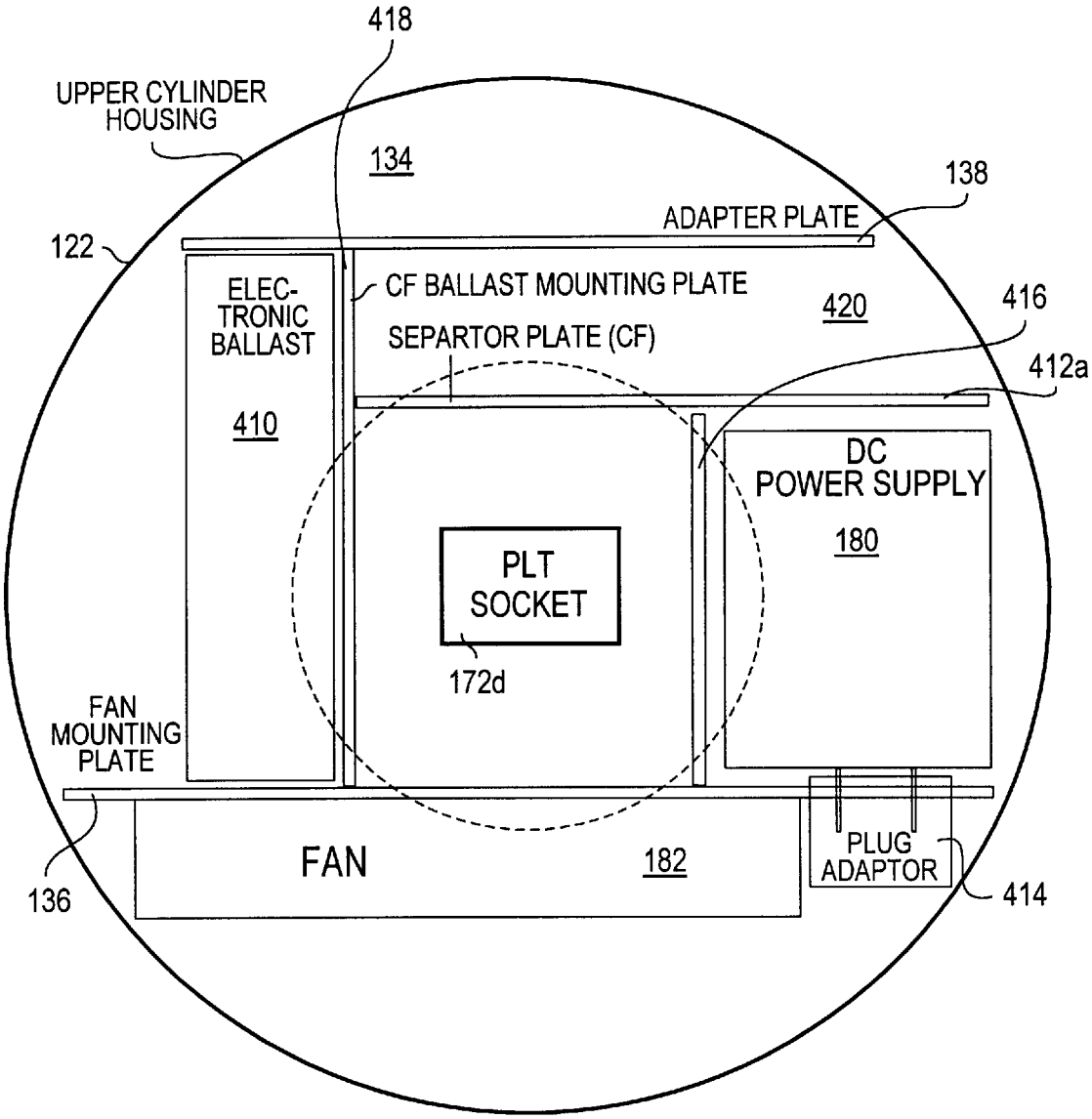
FIG. 4D is a top plan part section view of a trim taken along line 4D of FIG. 2B.

FIG. 4D is a top plan view of assembly 406 taken along section line 4D of FIG. 4B. Fan 182 is secured to fan mounting plate 136, which is vertically secured to baffle plate 134. Plug adapter 414 is secured in fan mounting plate 136 within a hole therein. Power supply 180 plugs into the plug adapter 414. A power supply separator plate 416 is affixed at a right angle to fan mounting plate 136 and adapter plate 138, to separate the power supply 180 from socket 172*d*. Opposite of socket 172*d* from power supply 180, electronic ballast 410 is secured to a ballast mounting plate, which is secured at a right angle to fan mounting plate 136 and adapter plate 138. A separator plate 412*a* is secured parallel to adapter plate 138 and fan mounting plate 136, perpendicular to ballast mounting plate 418 and perpendicular to power supply separator plate 416. The separator plate 412*a* and adapter plate 138 defines a wiring compartment 420 through which wiring for the ballast 410 and plug adapter 414 may be routed.

In this configuration, ballast 410, power supply 180, and fan 182 are compactly and efficiently arranged about socket 172*d*.

OTHER MECHANICAL ELEMENTS

Figure 5A:
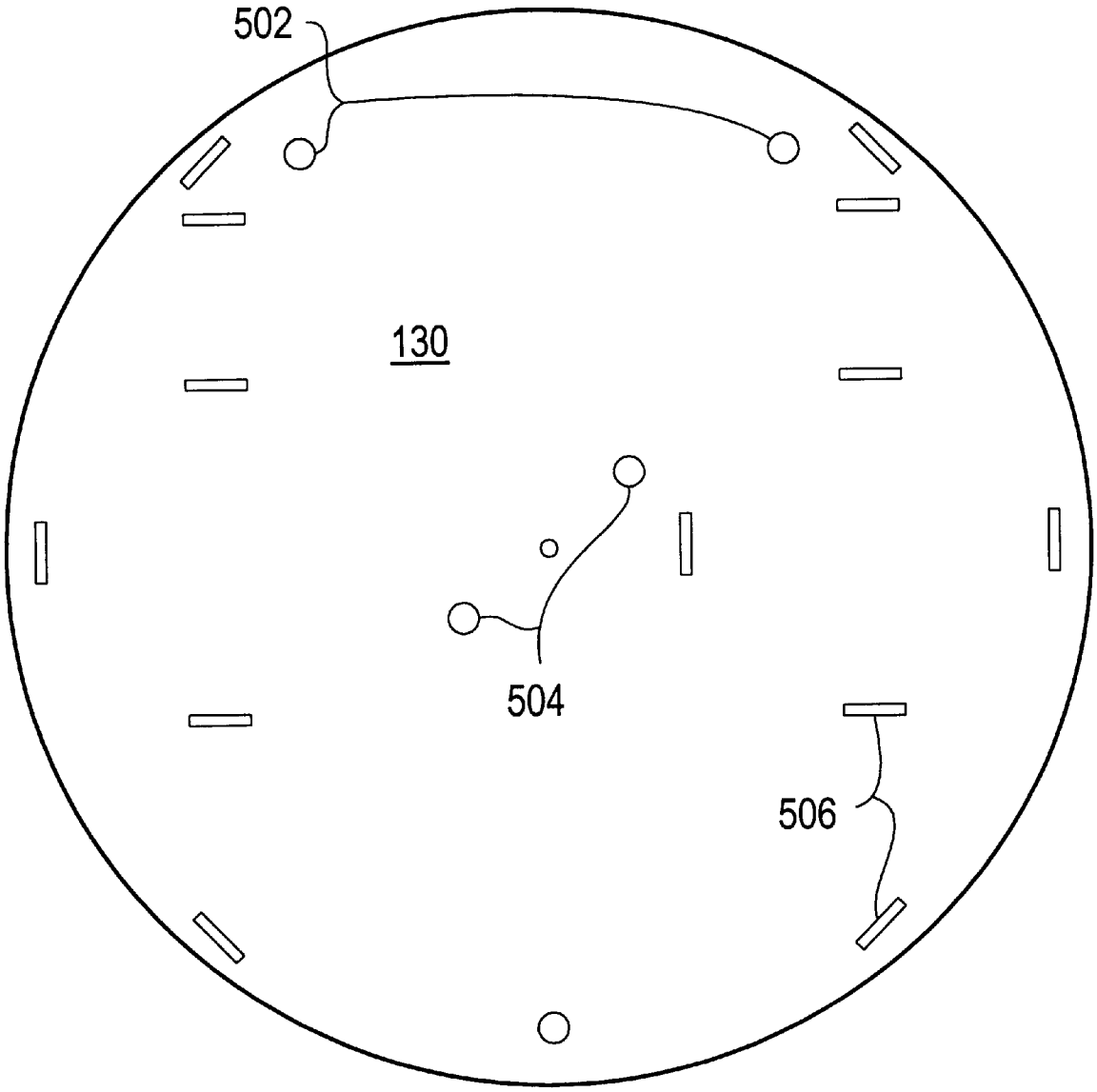
FIG. 5A is a top plan view of a top plate.

FIG. 5A is a top plan view of an embodiment of top plate 130 showing mechanical details thereof. Top plate 130 preferably comprises a generally circular sheet plate of sheet metal or other suitably rigid material. One or more holes 502 are disposed in the plate 130 to facilitate attachment of the trim top plate to an electronic metal halide ballast, when one is used. Other holes 504 are for mounting fluorescent socket 172*d* of the embodiment of FIG. 4B. Holes 402, 504 may also receive fasteners that secure internal components of the trim to the plate 130. One or more slots 506 may receive corresponding tabs of internal elements such as plates 136, 138, 140, 142 to enable the plates to be secured in the plate 130 to form a rigid assembly.

Figure 5B:
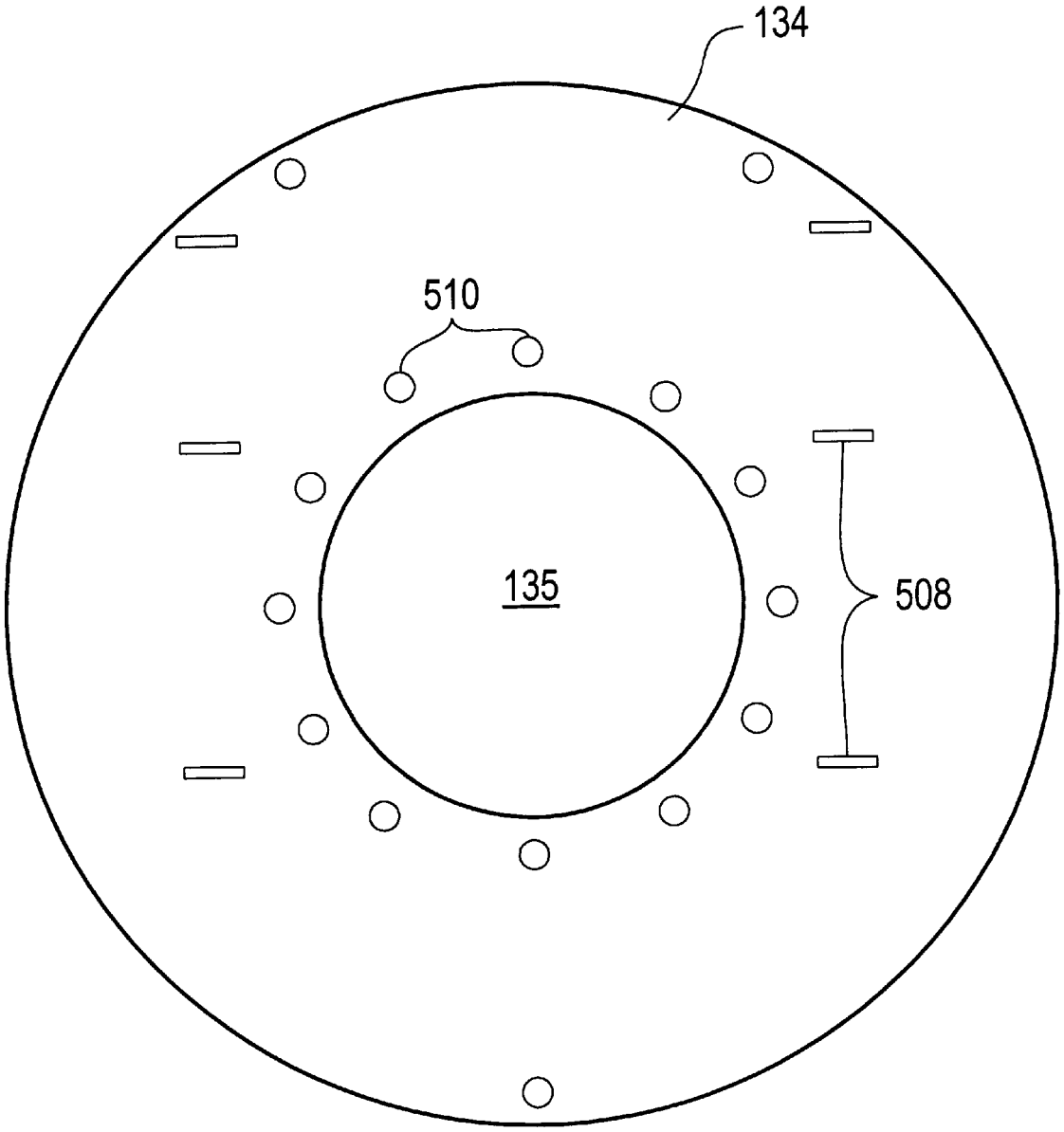
FIG. 5B is a top plan view of a baffle plate.
Figure 56:
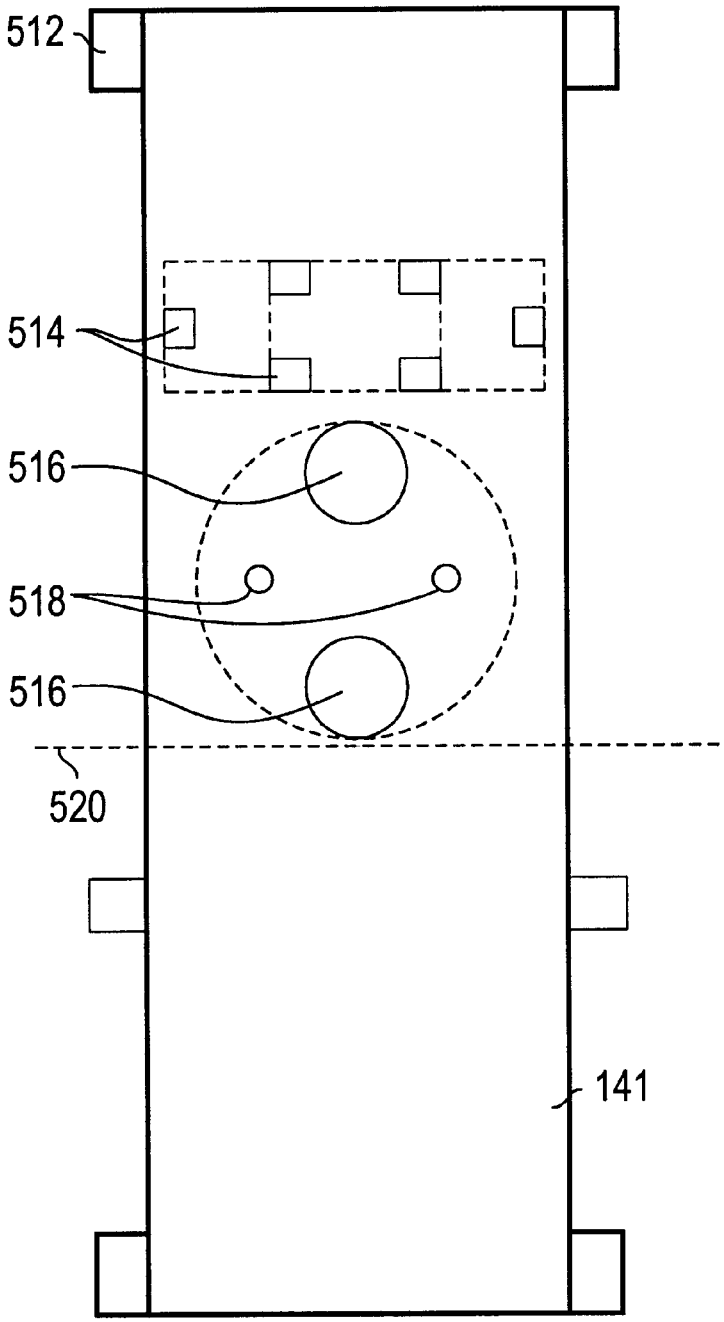

FIG. 5B is a top plan view of an embodiment of baffle plate 134 showing mechanical details thereof. Baffle plate 134 preferably comprises a generally ring-shaped plate of sheet metal or other supporting material and has a centrally disposed hole 135 through which the neck of a lamp may protrude. One or more slots 508 may receive corresponding tabs of internal elements such as plates 136, 138, 140, 142 to enable the plates to be secured in the plate 134 to form a rigid assembly. One or more holes 510 are disposed near the perimeter of plate 134 and may be used to secure internal elements of the trim 120 or to secure a trim insert to the plate 134.

FIG. 5C is a top plan view of an embodiment of socket plate 141 showing mechanical details thereof Plate 141 has one or more tabs 512 that are received in corresponding slots 525 of adaptor plate 138 (FIG. 5D) to secure the plate to the baffle plate 141. One or more thermal protector mounting holes 514 are disposed in an end of plate 141 to receive fasteners that secure the thermal protector 183 to the plate. At least one socket wire clearance hole 516 is disposed generally centrally in plate 141. Supply voltage wires pass through clearance holes 516 to reach lamp socket 172. One or more socket mounting holes 518 receive fasteners that secure the socket 172 to plate 141.

Line 520 indicates a fold or bend position at which plate 141 is folded to form a right angle shape, having a vertical portion that is secured at its lower end to baffle plate 134, and a horizontal portion disposed above the socket 172 and parallel to the baffle plate. In this configuration, plate 141 acts as a hanger or bracket for socket 172.

Figure 5D:
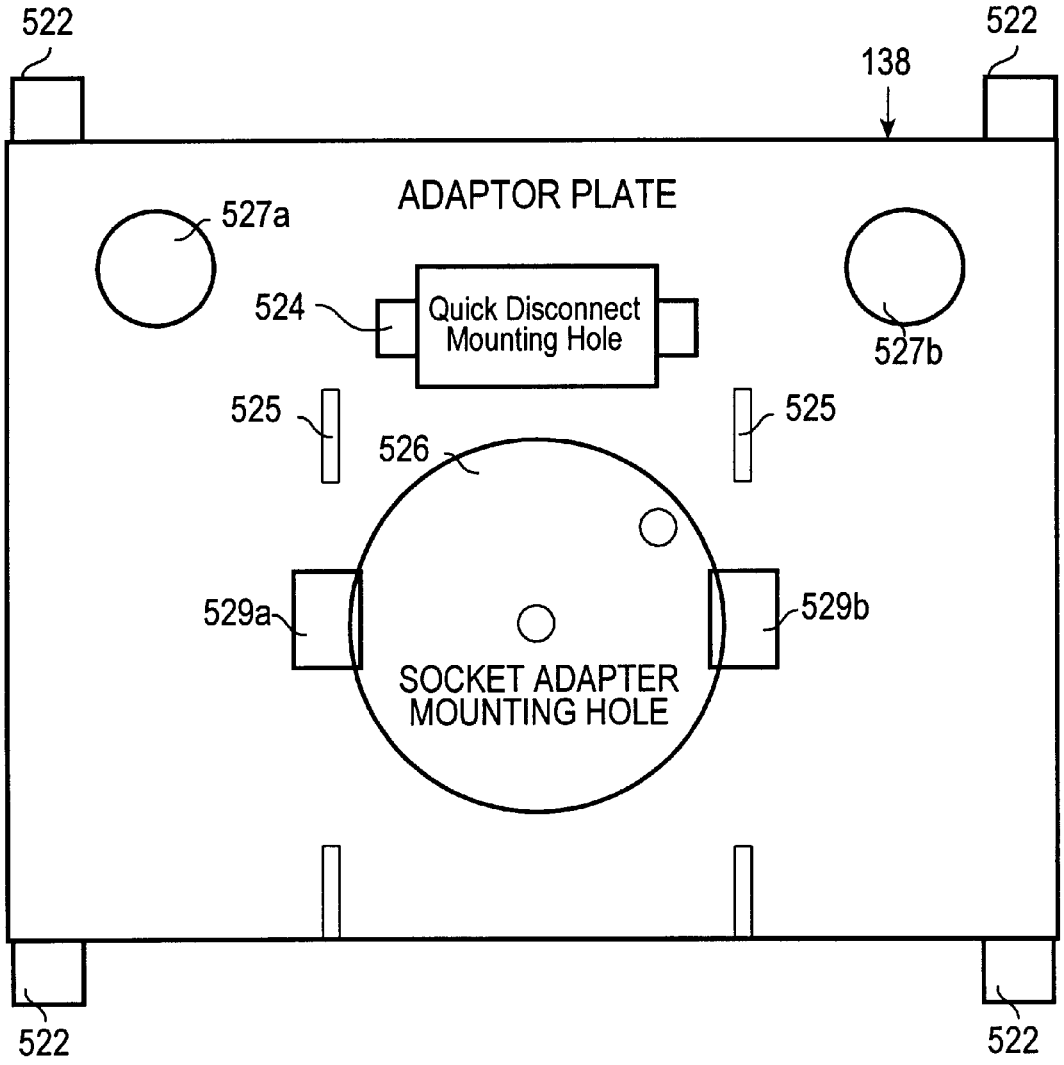
FIG. 5D is a top plan view of an adapter plate.

FIG. 5D is a top plan view of an embodiment of adapter plate 138 showing mechanical details thereof. Adapter plate 138 may have one or more tabs 522 that are received in corresponding slots of the top plate 130 and the baffle plate 134 to fix the adapter plate in position therewith. A quick disconnect mounting hole 524 is provided, in which adapter plate 138 may receive a quick-disconnect connector that feeds supply voltage from junction box 106 to socket adapter 178. Socket adapter 178 has integral spring clips that snaps into slots 529*a*, 529*b* adjacent to hole 526. Socket 176 is mounted in socket adapter mounting hole 526. Wiring may pass through holes 527*a*, 527*b*.

Figure 5E:
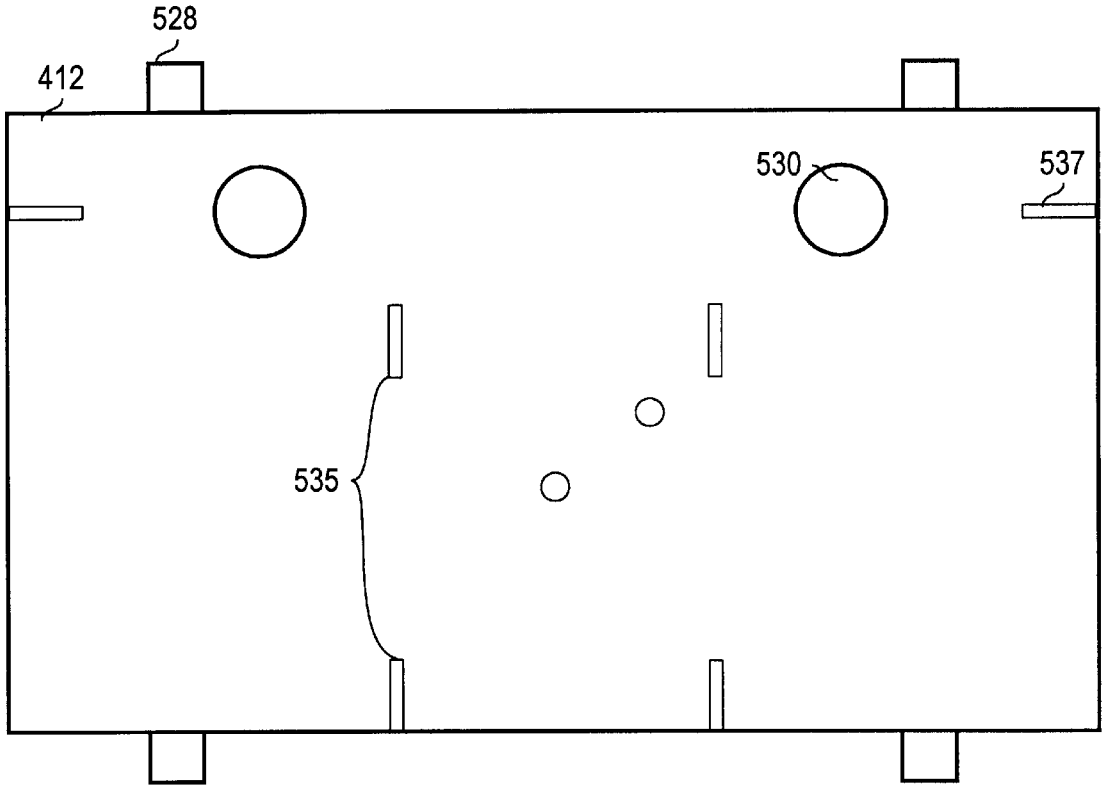
FIG. 5E is a top plan view of a separator plate.

FIG. 5E is a top plan view of an embodiment of separator plate 412. Tabs 528 arc provided to enable the plate 412 to be secured to baffle plate 134 and top plate 130. Vertical slots 535, 537 engage corresponding tabs of socket mounting bracket 141. Plate 412 also has wiring holes 530.

Figure 5F:
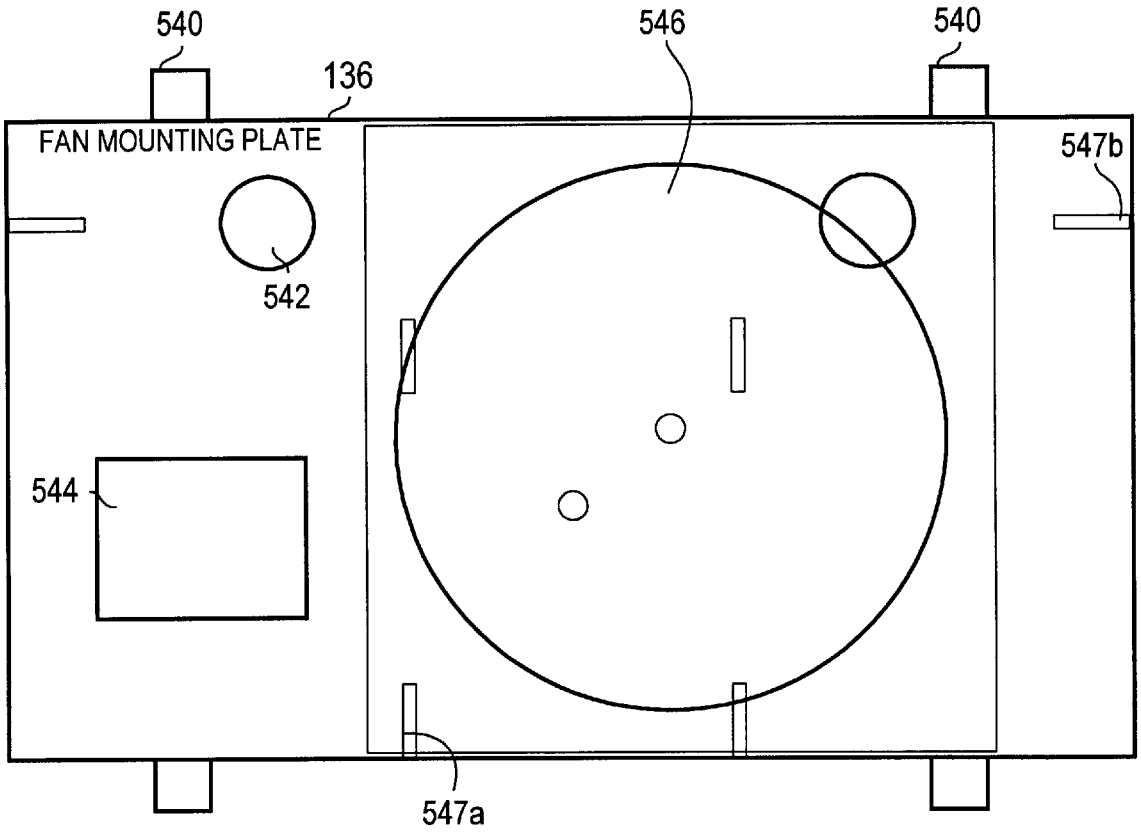
FIG. 5F is a top plan view of a fan mounting plate.

FIG. 5F is a top plan view of fan mounting plate 136 showing certain mechanical details thereof. Plate 136 may have one or more tabs 540 that are received in slots of the baffle plate 134 and top plate 130 to join the plate 136 to them. Plate 136 has a wiring hole 542 through which electrical wires arc routed and a generally square hole 544 that accepts the plug adapter 414. Tabs of socket mounting bracket 141 are received in slots 547*a*, 547*b*. A large, generally circular hole 546 is disposed generally centrally in plate 136. Fan 182 is surface mounted over hole 546. What is important is that fan 182 is rigidly mounted in trim 120 and has clear means to receive and to discharge or exhaust a cooling fluid, such as ambient atmosphere or air.

While sheet metal is contemplated for use as structural material in the preferred embodiment, other embodiments may be made of plastic materials, composite materials, or other materials.

ELECTRICAL ELEMENTS AND INTERCONNECTIONS

Figure 6A:
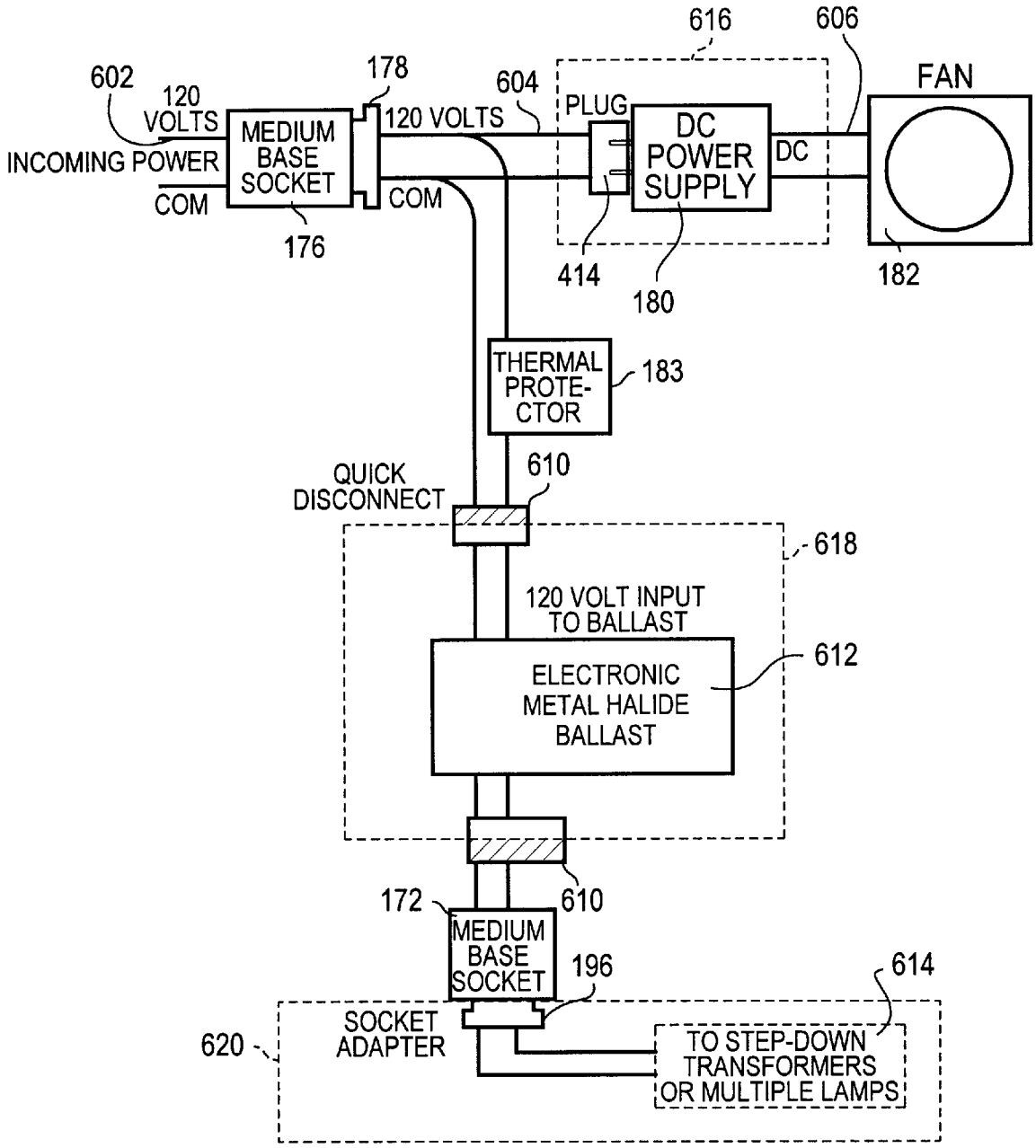
FIG. 6A is a block schematic diagram of electrical elements of the embodiment of FIG. 2A.

FIG. 6A is a block diagram that schematically shows electrical connections, electric elements, and wiring of an embodiment of the assembly 200.

Supply voltage, such as 120 volts AC, arrives at the assembly on wires 602, which are coupled to socket 176. Socket adapter 178 is screwed into the socket 176 and feeds the supply voltage on wires 604 to convenience socket 414. Power supply 180 is plugged into socket 414 to receive voltage therefrom. Power supply 180 provides low-voltage output on wires 606 to fan 182. The elements within box 616 of FIG. 6A may not be required when fan 182 is an AC fan. Supply voltage is also routed, in parallel to the foregoing elements, on wires 608 to thermal protector 183, which is series coupled to one of the wires 608.

When a metal halide lamp is used in the assembly, one wire 608 and one terminal of thermal protector 183 are optionally coupled to an electronic metal halide ballast 612, which may be positioned in space 190 of assembly 200. Wiring to and from ballast 612 may be connected using quick-disconnects 610, for convenience of installation and removal. The elements within box 618 may be required only when a metal halide lamp is used.

The supply voltage from wires 608 and thermal protector 183 is coupled to socket 172. When a metal halide lamp is used, socket 172 is pulse rated. A lamp may be screwed into socket 172 for illumination using the supply voltage. Alternative or optional elements are shown in box 620. A socket adapter 196 may be screwed into the socket 172 and may route power to one or more step-down transformers, or to one or more lampholders and lamps, as indicated by block 614. For example, socket adapter 196 may route power to a plurality of low-voltage step-down transformers, each of which feeds low-voltage power to a low-voltage lamp, such as type MR-16. Alternatively, socket adapter 196 may couple power to a plurality of sockets that are coupled in parallel. This enables use of the assembly with multiple line voltage lamps such as type PAR-20, K-19, PAR-16, and others.

Figure 6B:
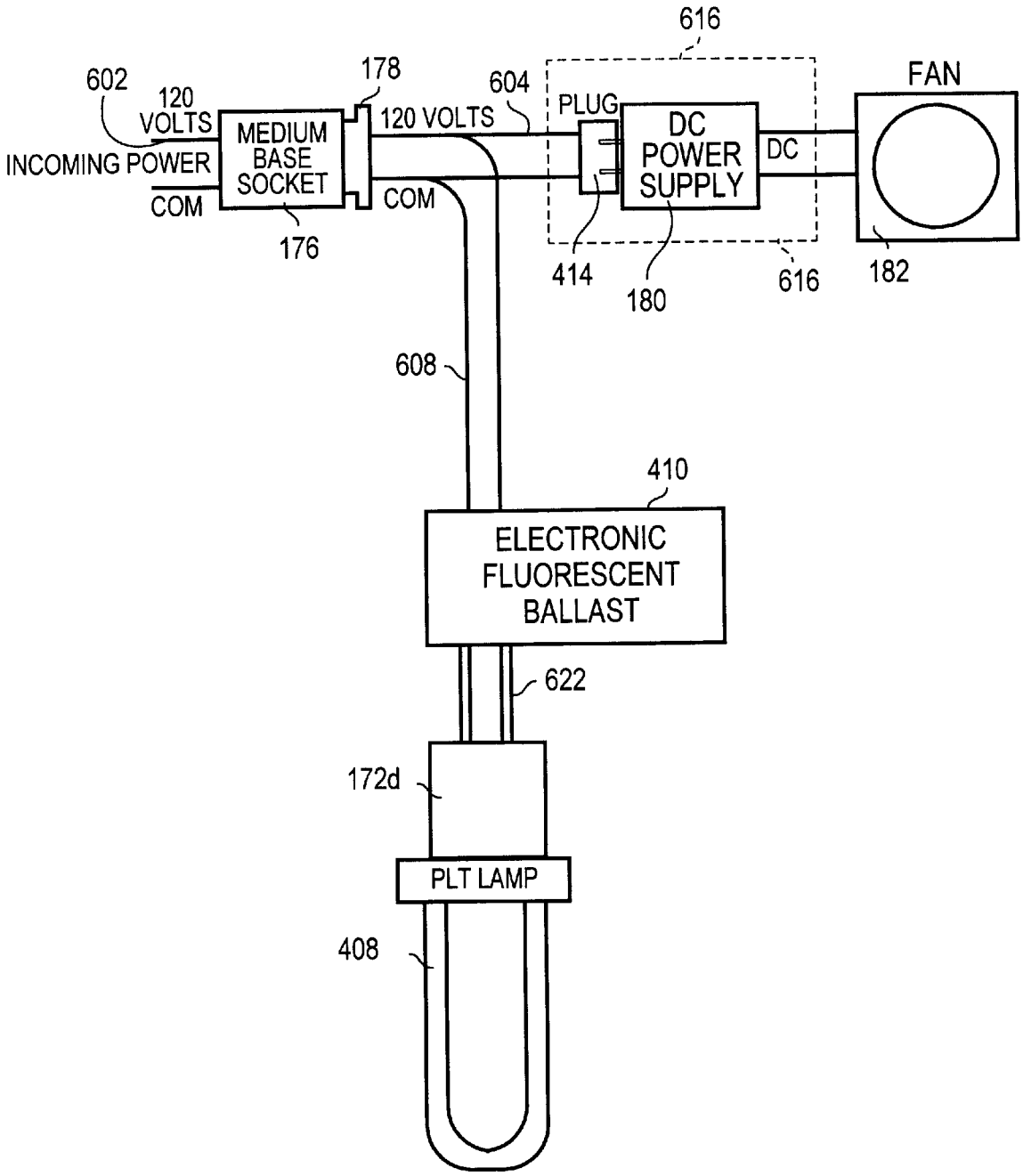
FIG. 6B is a block schematic diagram of electrical elements of the embodiment of FIG. 4B.

FIG. 6B is a block diagram that schematically shows electrical connections, electric elements, and wiring of an embodiment of assembly 406 of FIG. 4B, which uses a fluorescent lamp 408. Wires 608 feed supply voltage to ballast 410. The thermal protector may be omitted because fluorescent lamps normally do not generate enough heat to cause a fire hazard if fan 182 fails. Output voltage from ballast 410 is coupled by wires 622 to socket 172*d*, in which lamp 408 is seated.

ADVANTAGES

The embodiments disclosed herein have certain distinct advantages over prior approaches. For example, because a trim of a preferred embodiment has an integral thermal protector, the trim can be used in any standard recessed lighting housing. Fundamentally, the temperature of the trim is controlled separate and independent from the temperature of the housing.

One embodiment of the trim can be converted to a metal halide PAR fixture by adding a conventional electronic ballast that is intended for use with metal halide lamps. Thus, an end user can install or buy the trim configured for use with an incandescent lamp, and then later upgrade or change the fixture to accommodate a metal halide lamp. Alternatively, when the lamp is configured with the ballast for a metal halide lamp and the ballast unexpectedly fails, the trim can be converted to operate with an incandescent lamp until a new ballast is obtained.

The preferred DC fan is quiet and reliable. The trim can be installed in existing lighting fixtures without making major modifications to the fixtures. Since the trim uses a standard medium-based socket adapter, the trim can be powered by any standard light fixture by screwing the adapter into the existing fixture's lamp socket.

The airflow path is through the fan first, before being heated by the lamp. Therefore, almost any fan can be used. In contrast, in Spearman et al., the air is drawn past the lamp and thereby heated before it goes through the fan. So the fan must be able to withstand elevated temperatures.

EXTENSIONS, VARIATIONS

In the foregoing specification, the invention has been described with reference to specific embodiments thereof. It will, however, be evident that various modifications and changes may be made thereto without departing from the broader spirit and scope of the invention. In particular, specific lamp types and sizes have been identified, however, the invention is equally applicable to other lamp types and sizes. For example, the trim may be used, alternatively, with lamps rated from less than 60 watts to 500 watts; multiple MR-16 lamps in combination with a magnetic transformer or an electronic transformer; multiple fixed PAR-16, PAR-20, PAR-30, or K-19 lamps; type A lamps; type R lamps; type T-4 quartz lamps; and others. A gimbaled apparatus may be affixed to the trim to accommodate a PAR-36 lamp. The specification and drawings are, accordingly, to be regarded in an illustrative rather than a restrictive sense.

What is claimed is:

1. An actively cooled lighting apparatus for use in conjunction with a first housing that receives a lamp, comprising:

a second housing comprising an outer wall that fits within and spaced apart from the first housing to thereby define a space between the outer wall and the first housing;

a plate mounted to the second housing and having one or more vents that admit to the space; and means for cooling the second housing by drawing a cooling fluid from outside the second housing, through the vents, through the space, and exhausting the cooling fluid around the lamp to outside the second housing.

2. The apparatus recited in claim 1, further comprising means, mounted within the second housing, for receiving the lamp.

3. The apparatus recited in claim 1, wherein the plate includes a hole through which the lamp protrudes such that the cooling fluid exhausts through a gap between the lamp and the plate.

4. The apparatus recited in claim 1, wherein the cooling means is a fan.

5. The apparatus recited in claim 1, wherein the cooling means is a low-voltage fan that receives supply voltage from a power supply mounted within the second housing.

6. The apparatus recited in claim 1, further comprising means in proximity with the second housing for de-energizing the lamp when a temperature about the second housing exceeds a pre-determined value.

7. The apparatus recited in claim 6, wherein the de-energizing means is a thermal protector.

8. The apparatus recited in claim 7, wherein the thermal protector is secured to the second housing adjacent to the lamp.

9. The apparatus recited in claim 1, wherein the cooling means is mounted in the second housing to receive cool fluid from outside the second housing and to exhaust the cool fluid to about the lamp.

10. The apparatus recited in claim 1, wherein the first housing is a ceiling-mounted recessed lighting fixture housing.

11. The apparatus recited in claim 1, further comprising means, removably mounted within the second housing, for receiving one or more lamps.

12. The apparatus recited in claim 11, wherein the second housing includes an outer wall having an access window through which the receiving means may be accessed for installation or removal thereof.

13. The apparatus recited in claim 11, wherein the receiving means comprises a removable trim insert that includes one or more lampholders, each of which receives a lamp.

14. The apparatus recited in claim 5, wherein the fan is a compact DC fan, and wherein the power supply is a compact DC power supply that is coupled in parallel to voltage source that also supplies the lamp.

15. The apparatus recited in claim 7, wherein the fan is a compact DC fan, and wherein the power supply is a compact DC power supply that is coupled in parallel to voltage source that also supplies the lamp, and wherein the thermal protector is series coupled in relation to the voltage source and the lamp.

16. The apparatus recited in claim 1, further comprising a means for receiving a relatively elongated lamp, and an extender section secured to the second housing that encloses the relatively elongated lamp.

17. The apparatus recited in claim 1, wherein the cooling means is a fan that receives supply voltage from a power supply mounted on the first housing.

18. The apparatus recited in claim 13, further comprising at least one step-down transformer that supplies reduced voltage to at least one of the lamps.

19. The apparatus recited in claim 13, further comprising a plurality of step-down transformers mounted within the second housing, wherein each of the transformers supplies reduced voltage to one of a plurality of lamps mounted on the trim insert.

20. The apparatus recited in claim 11, further comprising: a second means for receiving a lamp mounted within the second housing; an adapter secured in the second means for receiving a lamp and electrically coupled to the means, removably mounted within the second housing, for receiving one or more lamps to thereby supply voltage to the lamps.

21. The apparatus recited in claim 1, further comprising an eyeball apparatus that is tiltably mounted in the second housing, the eyeball apparatus including a trim ring having at least one intake vent disposed therein and a mounting plate having at least one exhaust vent disposed therein.

22. The apparatus recited in claim 1, further comprising: means in the second housing for receiving an A-type lamp; and a reflector that is mounted in the second housing to downwardly reflect light from the A-type lamp.

23. The apparatus recited in claim 1, further comprising: means in the second housing for receiving a fluorescent lamp; and a fluorescent lamp ballast in the second housing and coupled to receive supply voltage therefrom and provide starting voltage to the fluorescent lamp.

24. A fan-cooled trim for use in conjunction with a first housing that receives a lamp, comprising:

a trim housing comprising an outer wall that fits within and spaced apart from the first housing to thereby define a space between the outer wall and the first housing;

a plate mounted to the second housing and having one or more vents that admit a cooling fluid to the space; and a fan mounted in the second housing for cooling thereof by drawing a cooling fluid from outside the second housing, through the vents, through the space, and exhausting the cooling fluid around the lamp to outside the second housing.

25. A fan-cooled trim for use in conjunction with a recessed lighting housing that receives a lamp, comprising:

a trim housing comprising an outer wall that fits within and spaced apart from the recessed lighting housing to thereby define a space between the outer wall and the recessed lighting housing;

a plate mounted to the second housing and having one or more vents that admit a cooling fluid to the space;

a fan mounted in the second housing for cooling thereof by drawing a cooling fluid from outside the second housing, through the vents, through the space, and exhausting the cooling fluid around the lamp to outside the second housing; and thermal protection means in proximity to the second housing for selectively de-energizing the lamp when a temperature of the second housing exceeds a pre-determined value.

26. An actively cooled lighting apparatus for use in conjunction with a first housing for a lighting fixture, comprising:

a trim housing mounted within the first housing and spaced-apart therefrom to thereby define a space between the trim housing and the first housing;

means mounted in the trim housing for receiving a lamp and spaced apart from the trim housing to thereby define a gap between the lamp and the trim housing when the lamp is mounted therein; and means for cooling the trim housing by drawing a cooling fluid from outside the trim housing, through the space, and exhausting the cooling fluid over the lamp through the gap to outside the trim housing.

27. The apparatus recited in claim 26, wherein the cooling means is a fan.

28. The apparatus recited in claim 26, wherein the cooling means is a low-voltage fan that receives supply voltage from a power supply mounted within the trim housing.

29. The apparatus recited in claim 26, further comprising means in proximity with the trim housing for de-energizing the lamp when a temperature about the trim housing exceeds a pre-determined value.

30. The apparatus recited in claim 29, wherein the de-energizing means is a thermal protector.

31. The apparatus recited in claim 26, wherein the first housing is a ceiling-mounted recessed lighting fixture housing.

32. The apparatus recited in claim 26, wherein the means for receiving a lamp further comprises means, removably mounted within the trim housing, for receiving one or more lamps.

33. The apparatus recited in claim 32, wherein the receiving means comprises a removable trim insert that includes one or more lampholders, each of which receives a lamp.

34. The apparatus recited in claim 33, further comprising at least one step-down transformer that supplies reduced voltage to at least one of the lamps.

35. The apparatus recited in claim 33, further comprising: a second means for receiving a lamp mounted within the trim housing; an adapter secured in the second means for receiving a lamp and electrically coupled to the means, removably mounted within the trim housing, for receiving one or more lamps to thereby supply voltage to the lamps.

36. The apparatus recited in claim 26, further comprising an eyeball apparatus that is tiltably mounted in the trim housing, the eyeball apparatus including a trim ring having at least one intake vent disposed therein and a mounting plate having at least one exhaust vent disposed therein.

37. The apparatus recited in claim 26, further comprising: means in the trim housing for receiving an A-type lamp; and a reflector that is mounted in the trim housing to downwardly reflect light from the A-type lamp.

* * * * *